US011480185B2

(12) United States Patent
Murakami et al.

(10) Patent No.: US 11,480,185 B2
(45) Date of Patent: Oct. 25, 2022

(54) BLOWING SYSTEM

(71) Applicant: Panasonic Corporation, Osaka (JP)

(72) Inventors: Hideki Murakami, Shiga (JP); Kimiaki Nakata, Osaka (JP); Yoshifumi Takasu, Osaka (JP); Koki Akiyoshi, Kanagawa (JP); Shinji Noda, Kanagawa (JP)

(73) Assignee: PANASONIC HOLDINGS CORPORATION, Osaka (JP)

( * ) Notice: Subject to any disclaimer, the term of this patent is extended or adjusted under 35 U.S.C. 154(b) by 14 days.

(21) Appl. No.: 17/329,939

(22) Filed: May 25, 2021

(65) Prior Publication Data

US 2021/0372415 A1 Dec. 2, 2021

(30) Foreign Application Priority Data

May 29, 2020 (JP) ..... JP2020-094160

(51) Int. Cl.

| | |
|---|---|
| ***F04D 29/40*** | (2006.01) |
| ***F04D 25/16*** | (2006.01) |
| ***F04D 29/66*** | (2006.01) |
| ***F04D 29/70*** | (2006.01) |
| ***F04D 29/64*** | (2006.01) |
| ***F04D 25/08*** | (2006.01) |

(52) U.S. Cl.

CPC ..... *F04D 25/166* (2013.01); *F04D 25/08* (2013.01); *F04D 29/403* (2013.01); *F04D 29/644* (2013.01); *F04D 29/661* (2013.01); *F04D 29/703* (2013.01)

(58) Field of Classification Search

CPC ..... F04D 25/166; F04D 25/08; F04D 29/403; F04D 29/644; F04D 29/661; F04D 29/703; H05K 7/20209; H05K 7/20581; H05K 7/20718

See application file for complete search history.

(56) References Cited

U.S. PATENT DOCUMENTS

2016/0381836 A1* 12/2016 Hall ..... H05K 7/20718 361/679.48

FOREIGN PATENT DOCUMENTS

| | | |
|---|---|---|
| JP | 53-135006 | 11/1978 |
| JP | 61-24619 | 6/1986 |
| JP | 2019-183691 | 10/2019 |

* cited by examiner

*Primary Examiner* — Aaron R Eastman

(74) *Attorney, Agent, or Firm* — Wenderoth, Lind & Ponack, L.L.P.

(57) ABSTRACT

A blowing system includes: a first blowing unit including a first body that houses a first fan and includes a first air outlet for blowing-out wind from the first fan; a second blowing unit including a second body that houses a second fan, includes a second air outlet for blowing-out wind from the second fan, and has a shape that is in two-fold symmetry with the first body; and a first connection that rotatably-connects an edge on a back face-side of a first side face of the first body and an edge on a back face-side of a second side face of the second body so that an angle formed by the first and second bodies is variable. The first and second blowing units come into contact at three or more points, and the directions of respective rotation axes of the first and second fans cross at a predetermined angle.

9 Claims, 16 Drawing Sheets

BLOWING SYSTEM

CROSS REFERENCE TO RELATED APPLICATION

The present application is based on and claims priority of Japanese Patent Application No. 2020-094160 filed on May 29, 2020. The entire disclosure of the above-identified application, including the specification, drawings and claims is incorporated herein by reference in its entirety.

FIELD

The present disclosure relates to a blowing system.

BACKGROUND

PTL 1 discloses a blowing device that includes multiple blowers.

CITATION LIST

Patent Literature

PTL 1: Japanese Unexamined Patent Application Publication No. 2019-183691

SUMMARY

Technical Problem

It has been desired to reduce vibrations generated in blowing systems such as the blowing device described in PTL 1.

An object of the present disclosure is to provide a blowing system capable of reducing vibrations generated.

Solution to Problem

A blowing system according to an aspect of the present disclosure includes: a first blowing unit including a first fan configured to rotate about a first rotation axis and a first body that is configured to house the first fan and includes, in a front face of the first body, a first air outlet from which wind generated by the first fan is blown out; a second blowing unit including a second fan configured to rotate about a second rotation axis and a second body that is configured to house the second fan and includes, in a front face of the second body, a second air outlet from which wind generated by the second fan is blown out, the second body being of a shape that is in two-fold symmetry with the first body with respect to a first axis of rotational symmetry which is parallel to the second rotation axis; and a first connection configured to rotatably connect an edge on a back face-side of a first side face of the first body and an edge on a back face-side of a second side face of the second body so that an angle formed by the first body and the second body is variable, wherein when the first blowing unit and the second blowing unit contact each other by being rotated about the first connection, the first side face of the first body and the second side face of the second body come into contact at three or more points which are mutually different, and a first direction in which the first rotation axis extends and a second direction in which the second rotation axis extends cross each other at a predetermined angle.

Advantageous Effects

A blowing system according to the present disclosure is capable of reducing vibrations generated.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Figure 1:
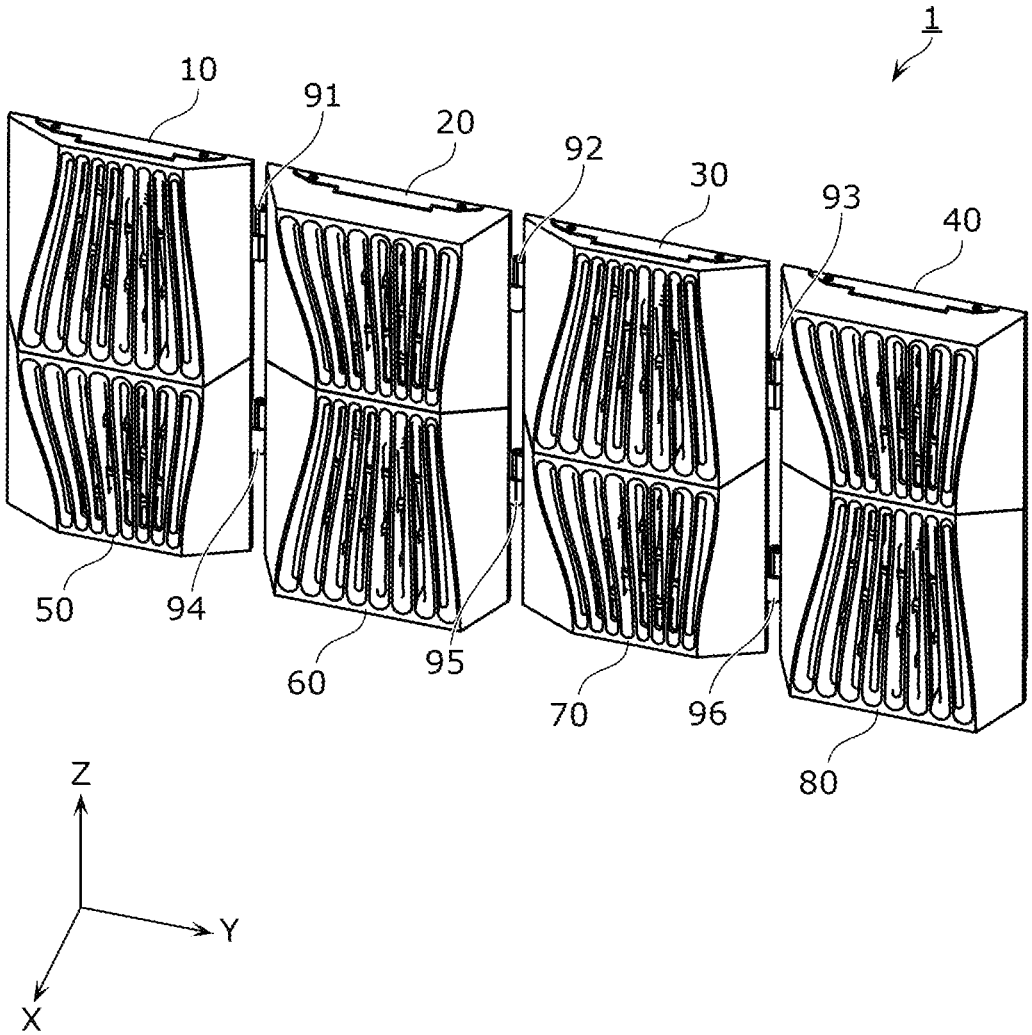
FIG. 1 is an external perspective view of a blowing system according to an exemplary embodiment.

A blowing system according to an aspect of the present disclosure includes: a first blowing unit including a first fan configured to rotate about a first rotation axis and a first body that is configured to house the first fan and includes, in a front face of the first body, a first air outlet from which wind generated by the first fan is blown out; a second blowing unit including a second fan configured to rotate about a second rotation axis and a second body that is configured to house the second fan and includes, in a front face of the second body, a second air outlet from which wind generated by the second fan is blown out, the second body being of a shape that is in two-fold symmetry with the first body with respect to a first axis of rotational symmetry which is parallel to the second rotation axis; and a first connection configured to rotatably connect an edge on a back face-side of a first side face of the first body and an edge on a back face-side of a second side face of the second body so that an angle formed by the first body and the second body is variable, wherein when the first blowing unit and the second blowing unit contact each other by being rotated about the first connection, the first side face of the first body and the second side face of the second body come into contact at three or more points which are mutually different, and a first direction in which the first rotation axis extends and a second direction in which the second rotation axis extends cross each other at a predetermined angle.

In this manner, when the blowing system is arranged to cause the first direction to cross the second direction at the predetermined angle, the first side face of the first body and the second side face of the second body come into contact at three or more different points. This enables the first body and the second body to function as a single rigid body. Thus, vibrations generated in the blowing system can be reduced.

For example, the first side face of the first body and the second side face of the second body may come into contact in a plane that includes the three or more points.

In this manner, the first side face of the first body and the second side face of the second body come into contact in a plane when contacting each other. This enables the first body and the second body to function more effectively as a single rigid body. Thus, vibrations generated in the blowing system can be further reduced.

For example, the plane in which the first side face of the first body and the second side face of the second body come into contact includes a curved portion.

In this manner, the first side face of the first body and the second side face of the second body come into contact in a wider area when contacting each other. This enables the first body and the second body to function more effectively as a single rigid body, thereby further reducing vibrations generated in the blowing system.

For example, the first side face of the first body may be of a shape that has two-fold symmetry with respect to a second axis of rotational symmetry, and the second side face of the second body may be of a shape that has two-fold symmetry with respect to a third axis of rotational symmetry.

In this manner, the first side face of the first body and the second side face of the second body come into contact in their entire areas when contacting each other. This enables the first body and the second body to function more effectively as a single rigid body. Thus, vibrations generated in the blowing system can be further reduced.

For example, the edge of the first side face of the first body at one end of the edge on a back face-side of the first side face of the first body and a back face of the first body may form a first angle, and the edge of the first side face of the first body at an other end of the edge on a back face-side of the first side face of the first body and a back face of the first body may form a second angle different from the first angle.

In this manner, the edge on the front-face side of the first side face of the first body can be elongated to increase the area of the first side face. This also applies to the second side face of the second body, because the second side face of the second body is the same in shape as the first side face of the first body. Consequently, the first side face of the first body and the second side face of the second body come into contact in a wider area when contacting each other. This enables the first body and the second body to function more effectively as a single rigid body, thereby further reducing vibrations generated in the blowing system.

For example, the blowing system may further include: a third blowing unit including a third fan configured to rotate about a third rotation axis and a third body that is configured to house the third fan and includes, in a front face of the third body, a third air outlet from which wind generated by the third fan is blown out, the third body being of a shape that is approximately identical to a shape of the first body; a fourth blowing unit including a fourth fan configured to rotate about a fourth rotation axis and a fourth body that is configured to house the fourth fan and includes, in a front face of the fourth body, a fourth air outlet from which wind generated by the fourth fan is blown out, the fourth body being of a shape that is approximately identical to a shape of the second body; a second connection configured to rotatably connect an edge on a back face-side of a first side face opposite the second side face of the second body and an edge on a back face-side of a second side face of the third body so that an angle formed by the second body and the third body is variable; and a third connection configured to rotatably connect an edge on a back face-side of a first side face opposite the second side face of the third body and an edge on a back face-side of a second side face of the fourth body so that an angle formed by the third body and the fourth body is variable. When the second blowing unit and the third blowing unit contact each other by being rotated about the second connection, the first side face of the second body and the second side face of the third body may come into contact at three or more points which are mutually different, and the second direction and a third direction in which the third rotation axis extends may cross each other at the predetermined angle. When the third blowing unit and the fourth blowing unit contact each other by being rotated about the third connection, the first side face of the third body and the second side face of the fourth body may come into contact at three or more points which are mutually different, and the third direction and a fourth direction in which the fourth rotation axis extends may cross each other at the predetermined angle. When the first side face of the first body and the second side face of the second body contact each other, and the first side face of the second body and the second side face of the third body contact each other, and the first side face of the third body and the second side face of the fourth body contact each other, the first side face of the fourth body and the second side face of the first body may contact each other.

In this manner, when the first side face of the first body and the second side face of the second body contact each other, and the first side face of the second body and the second side face of the third body contact each other, and the first side face of the third body and the second side face of the fourth body contact each other, the first side face of the fourth body and the second side face of the first body contact each other. That is, the first body, the second body, the third body, and the fourth body are arranged circularly and contact each adjacent body in a plane. This enables the first body, the second body, the third body, and the fourth body to function more effectively as a single rigid body. Thus, vibrations generated in the blowing system can be further reduced.

For example, edges on back face-sides of the first side face and the second side face of each of the first body, the second body, the third body, and the fourth body may extend in an approximately same direction, and a position of the first connection in the approximately same direction may be different from a position of the third connection in the approximately same direction.

In this manner, when the back faces of the first body and the second body are disposed to oppose the back faces of the third body and the fourth body, the first connection connecting the first body and the second body does not interfere with the third connection connecting the third body and the fourth body. Consequently, the blowing system can be arranged in a shape such that the back face of the first body contacts the back face of the fourth body, and the back face of the second body contacts the back face of the third body. This enables the first body, the second body, the third body, and the fourth body to function more effectively as a single rigid body, thereby further reducing vibrations generated in the blowing system.

For example, the blowing system may further include: a fifth blowing unit including a fifth fan configured to rotate about a fifth rotation axis and a fifth body that is configured to house the fifth fan and includes, in a front face of the fifth body, a fifth air outlet from which wind generated by the fifth fan is blown out, the fifth body being of a shape that is approximately identical to a shape of the second body; a sixth blowing unit including a sixth fan configured to rotate about a sixth rotation axis and a sixth body that is configured to house the sixth fan and includes, in a front face of the sixth body, a sixth air outlet from which wind generated by the sixth fan is blown out, the sixth body being of a shape that is approximately identical to a shape of the first body; a fifth connection configured to rotatably connect an edge on a back face-side of a first side face the fifth body and an edge on a back face-side of a second side face of the sixth body so that an angle formed by the fifth body and the sixth body is variable. Here, a third side face of the first body may be connected to a fourth side face of the fifth body, the third side face of the first body being approximately orthogonal to the edge on the back face-side of the first side face of the first body, the fourth side face of the fifth body being approximately orthogonal to the edge on the back face-side of the first side face the fifth body. A third side face of the second body may be connected to a fourth side face of the sixth body, the third side face of the second body being approximately orthogonal to the edge on the back face-side of the second side face of the second body, the fourth side face of the sixth body being approximately orthogonal to the edge on the back face-side of the second side face the sixth body. When the fifth blowing unit and the sixth blowing unit contact each other by being rotated about the fifth connection, the first side face of the fifth body and the second side face of the sixth body may come into contact at three or more points which are mutually different, and a fifth direction in which the fifth rotation axis extends and a sixth direction in which the sixth rotation axis extends may cross each other at a predetermined angle.

In this manner, when the blowing system is arranged to cause the fifth direction to cross the sixth direction at the predetermined angle, the first side face of the fifth body and the second side face of the sixth body come into contact at three or more different points. This enables the fifth body and the sixth body to function as a single rigid body. Thus, vibrations generated in the blowing system can be reduced.

For example, the first blowing unit may further include a first connector disposed in the third side face of the first body and configured to receive power, and the second blowing unit may further include a first connector disposed on the third side face of the second body and configured to receive power. The fifth blowing unit may further include a second connector disposed on a fourth side face opposite a third side face of the fifth body and configured to supply power, and the sixth blowing unit may further include a second connector disposed on a fourth side face opposite a third side face of the fifth body and configured to supply power. Each of the first connector of the first blowing unit and the first connector of the second blowing unit may be a male connector including a protruding terminal for receiving power, and each of the second connector of the fifth blowing unit and the second connector of the sixth blowing unit may be a female connector including a concealed terminal for supplying power. The first connector of the first blowing unit may be connected to the second connector of the fifth blowing unit by connecting the first body and the fifth body, and the first connector of the second blowing unit may be connected to the second connector of the sixth blowing unit by connecting the first body and the fifth body.

In this manner, the first connector for receiving power is a male connector, and the second connector for supplying power is a female connector. This can prevent a person from accidentally touching the terminal of the second connector that is ready to supply power.

Hereinafter, a blowing system according to an aspect of the present disclosure will be described in detail with reference to the Drawings.

It should be noted that each of the exemplary embodiments described below shows a specific example of the present disclosure. The numerical values, shapes, materials, structural components, the arrangement and connection of the structural components, steps, the processing order of the steps etc. shown in the following exemplary embodiments are mere examples, and therefore do not limit the scope of the present disclosure. Therefore, among the structural components in the following exemplary embodiments, those not recited in any one of the independent claims are described as optional structural components.

Embodiment

Configurations of a blowing system according to an exemplary embodiment will be described.

FIG. 1 is an external perspective view of the blowing system according to the embodiment. In the figures to be described below, the X-axis direction denotes the front-back direction, the Y-axis direction denotes the right-left direction, and the Z-axis direction denotes the top-bottom direction. The tip of an arrow of each of the X-axis direction, the Y-axis direction, and the Z-axis direction corresponds to the positive direction on the axis, whereas the opposite end of the arrow corresponds to the negative direction on the axis. The X-axis positive direction points forward, whereas the X-axis negative direction points backward. The Y-axis positive direction points rightward, whereas the Y-axis negative direction points leftward. The Z-axis positive direction points upward, whereas the Z-axis negative direction points downward. The X-axis direction, the Y-axis direction, and the Z-axis direction are orthogonal to each other.

As shown in FIG. 1, blowing system 1 includes first blowing unit 10, second blowing unit 20, third blowing unit 30, fourth blowing unit 40, fifth blowing unit 50, sixth blowing unit 60, seventh blowing unit 70, eighth blowing unit 80, first connection 91, second connection 92, third connection 93, fourth connection 94, fifth connection 95, and sixth connection 96.

First blowing unit 10, second blowing unit 20, third blowing unit 30, and fourth blowing unit 40 are arranged side by side in this order in the Y-axis direction. First blowing unit 10 and second blowing unit 20 are connected by first connection 91 to be rotatable with respect to each other about the Z-axis direction. Similarly, second blowing unit 20 and third blowing unit 30 are connected by second connection 92 to be rotatable with respect to each other about the Z-axis direction. Similarly, third blowing unit 30 and fourth blowing unit 40 are connected by third connection 93 to be rotatable with respect to each other about the Z-axis direction.

Fifth blowing unit 50, sixth blowing unit 60, seventh blowing unit 70, and eighth blowing unit 80 are arranged side by side in this order in the Y-axis direction. Fifth blowing unit 50, sixth blowing unit 60, seventh blowing unit 70, and eighth blowing unit 80 are arranged on the Z-axis negative-direction side of first blowing unit 10, second blowing unit 20, third blowing unit 30, and fourth blowing unit 40, respectively, and are connected with first blowing unit 10, second blowing unit 20, third blowing unit 30, and fourth blowing unit 40, respectively, in the Z-axis direction. Fifth blowing unit 50 and sixth blowing unit 60 are connected by fourth connection 94 to be rotatable with respect to each other about the Z-axis direction. Similarly, sixth blowing unit 60 and seventh blowing unit 70 are connected by fifth connection 95 to be rotatable with respect to each other about the Z-axis direction. Similarly, seventh blowing unit 70 and eighth blowing unit 80 are connected by sixth connection 96 to be rotatable with respect to each other about the Z-axis direction.

In the arrangement in FIG. 1, blowing units 10, 20, 30, 40, 50, 60, 70, and 80 blow out wind in the X-axis direction. Blowing units 10, 20, 30, 40, 50, 60, 70, and 80 can blow out wind in the X-axis positive direction and negative direction. Each of blowing units 10, 20, 30, 40, 50, 60, 70, and 80 can be independently controlled. As an example, while blowing unit 10 blows out wind, blowing unit 20 can be stopped. As another example, blowing unit 10 and blowing unit 20 can be controlled to blow out different volumes of wind.

Figure 3:
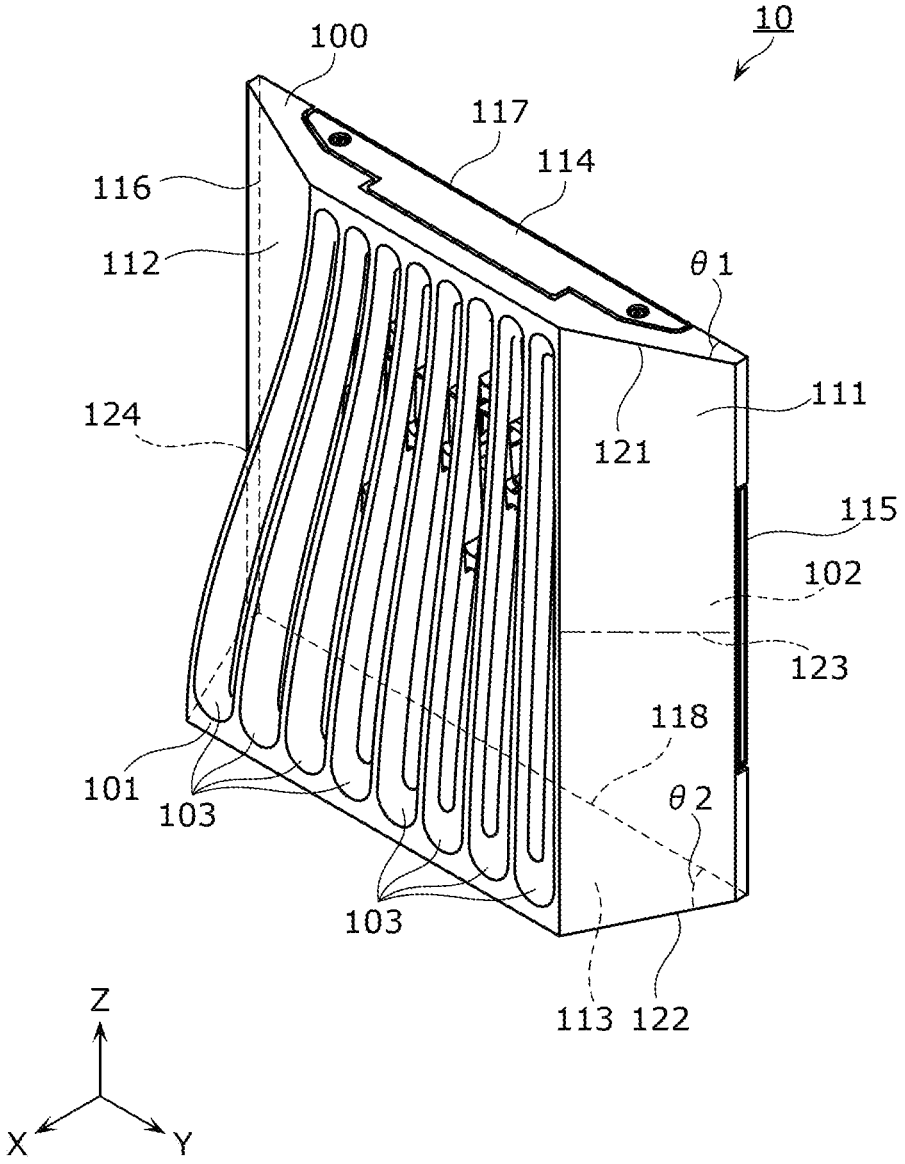
FIG. 3 is an external perspective view of the first blowing unit as seen from above.
Figure 4:
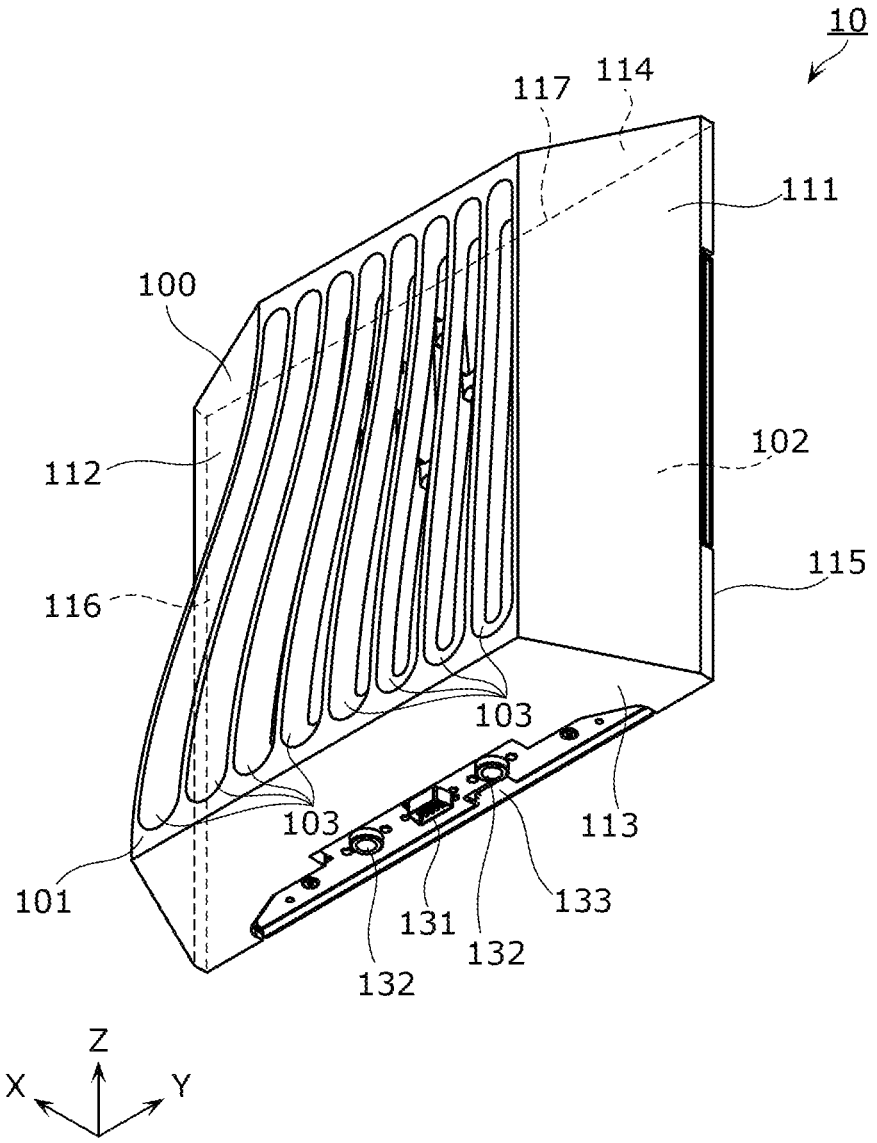
FIG. 4 is an external perspective view of the first blowing unit as seen from below.

Now, the configuration of first blowing unit 10 will be described with reference to FIGS. 2 to 4.

Figure 2:
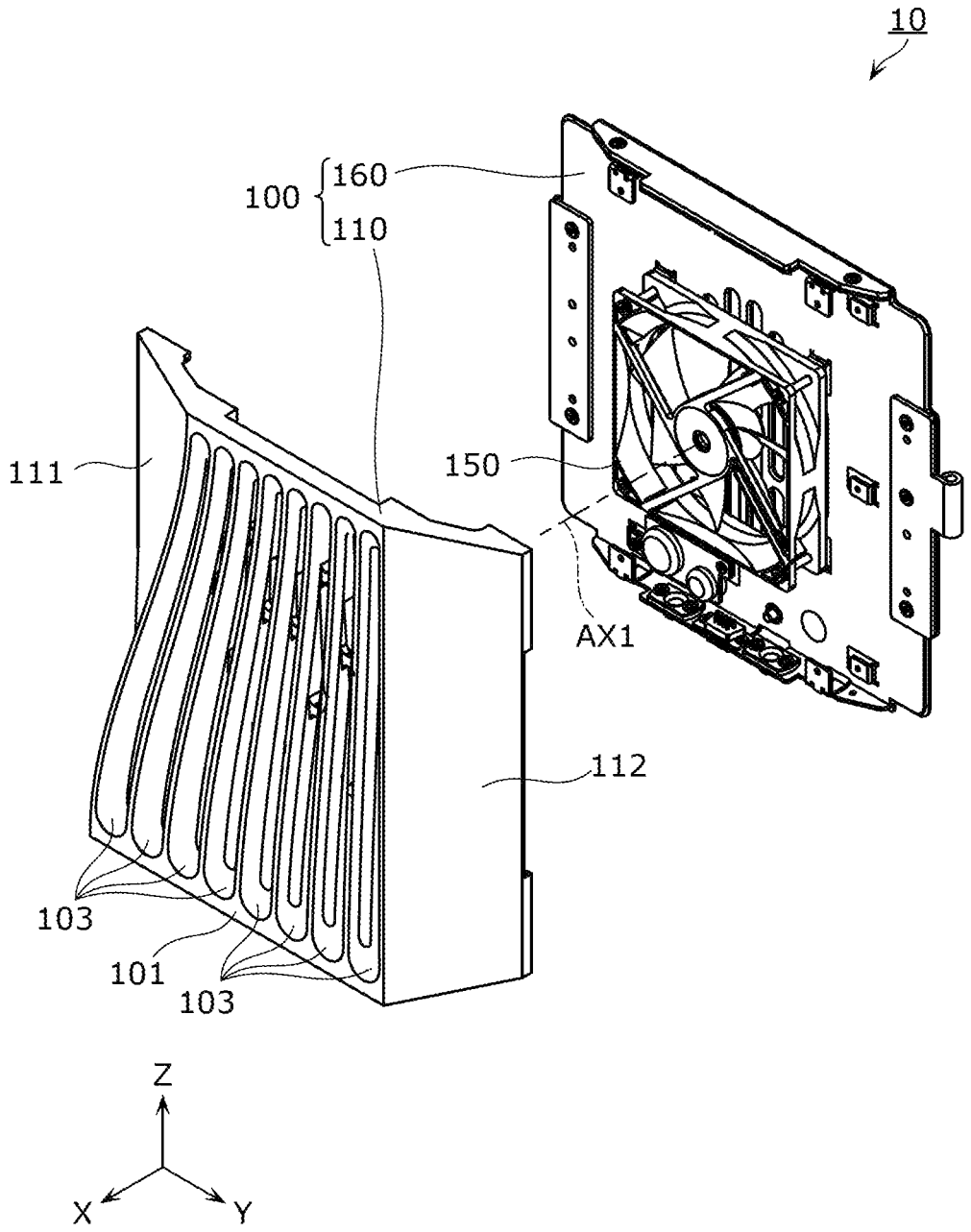
FIG. 2 is an exploded perspective view of a first blowing unit.

FIG. 2 is an exploded perspective view of the first blowing unit. FIG. 3 is an external perspective view of the first blowing unit as seen from above. FIG. 4 is an external perspective view of the first blowing unit as seen from below.

First blowing unit 10 includes body 100 and first fan 150. Body 100 houses first fan 150, and has air outlets 103 formed in front face 101 so that wind generated by first fan 150 is blown out from air outlets 103. Air outlets 103 are openings penetrating through front face 101 in the X-axis direction for taking in air in front of body 100 or for blowing out air toward front of body 100. Multiple (eight in this embodiment) air outlets 103 are formed in front face 101.

Body 100 includes frame 110 and back panel 160. Frame 110 has front face 101, first side face 111 serving as the right-side face, and second side face 112 serving as the left-side face. Frame 110 further has part of third side face 113 serving as the bottom-side face, and part of fourth side face 114 serving as the top-side face. Back panel 160 has back face 102. Back panel 160 further has part of third side face 113 serving as the bottom face, and part of fourth side face 114 serving as the top face. First fan 150 is disposed in the space surrounded by front face 101, back face 102, first side face 111, second side face 112, third side face 113, and fourth side face 114 of body 100. It is to be noted that back panel 160 may have openings (not shown) for taking in air in back of body 100 or for blowing out air toward back of body 100.

First side face 111 and second side face 112 are inclined to approach each other in the Y-axis direction toward the front. That is, first side face 111 and second side face 112 each form an angle of less than 90 degrees with back face 102. First side face 111 and second side face 112 are curved so that the angle with back face 102 decreases toward the top. Therefore, first angle θ1 between upper edge 121 of first side face 111 and back face 102 is smaller than second angle θ2 between lower edge 122 of first side face 111 and back face 102. First angle θ1 and second angle θ2 are thus different.

First side face 111 is of a shape that has two-fold symmetry with respect to axis 123, which is the axis of rotational symmetry, passing through the center of the width of first side face 111 in the Z-axis direction. That is, first side face 111 rotated 180 degrees about axis 123 is the same in shape as first side face 111 before being rotated 180 degrees. As with first side face 111, second side face 112 is of a shape that has two-fold symmetry with respect to axis 124, which is the axis of rotational symmetry, passing through the center of the width of second side face 112 in the Z-axis direction. That is, second side face 112 rotated 180 degrees about axis 124 is the same in shape as second side face 112 before being rotated 180 degrees.

Third side face 113 and fourth side face 114 in this embodiment are approximately parallel to the X-Y plane. Third side face 113 and fourth side face 114 are trapezoidal. The width of third side face 113 in the X-axis direction is greater than the width of fourth side face 114 in the X-axis direction.

Back face 102 in this embodiment is approximately parallel to the Y-Z plane. Back face 102 is rectangular, for example. Back face 102 may be square.

Front face 101 is curved to gradually recede as its width in the X-axis direction decreases toward the top. Front face 101 has curved edges at both ends in the Y-axis direction, and straight edges at both ends in the Z-axis direction. Front face 101 is symmetric with respect to an X-Z plane passing through the center of the width of body 100 in the X-axis direction.

Body 100 is symmetric with respect to the X-Z plane passing through the center of the width of body 100 in the X-axis direction.

Although body 100 includes frame 110 and back panel 160, body 100 is not limited to the configuration as described above. Body 100 may have any configuration that has internal space accommodating first fan 150 and that has front face 101, back face 102, first side face 111, second side face 112, third side face 113, and fourth side face 114.

First fan 150 is rotated about first rotation axis AX1 parallel to the X-axis direction. First fan 150 is controlled to be rotated in the forward or backward direction. When controlled to be rotated in the forward direction, first fan 150 blows out wind in the X-axis positive direction. When controlled to be rotated in the backward direction, first fan 150 blows out wind in the X-axis negative direction.

First blowing unit 10 further includes first connector 131 disposed on third side face 113 and configured to receive power. First connector 131 is a male connector having a protruding terminal for receiving power.

First blowing unit 10 further includes two insertion holes 132 and opening 133 disposed on third side face 113. Details of the functions of two insertion holes 132 and opening 133 will be described below.

Now, the configuration of second blowing unit 20 will be described with reference to FIGS. 5 and 6.

Figure 5:
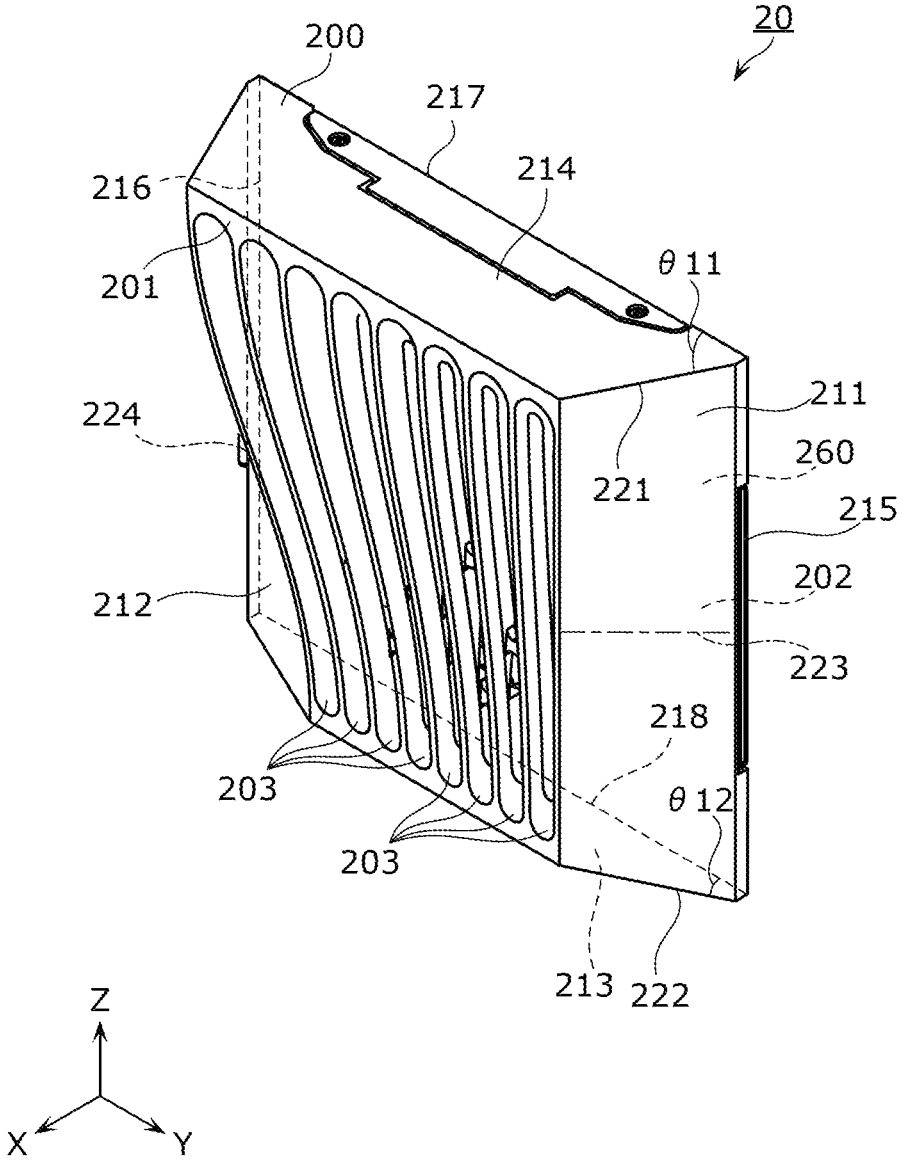
FIG. 5 is an external perspective view of a second blowing unit as seen from above.
Figure 6:
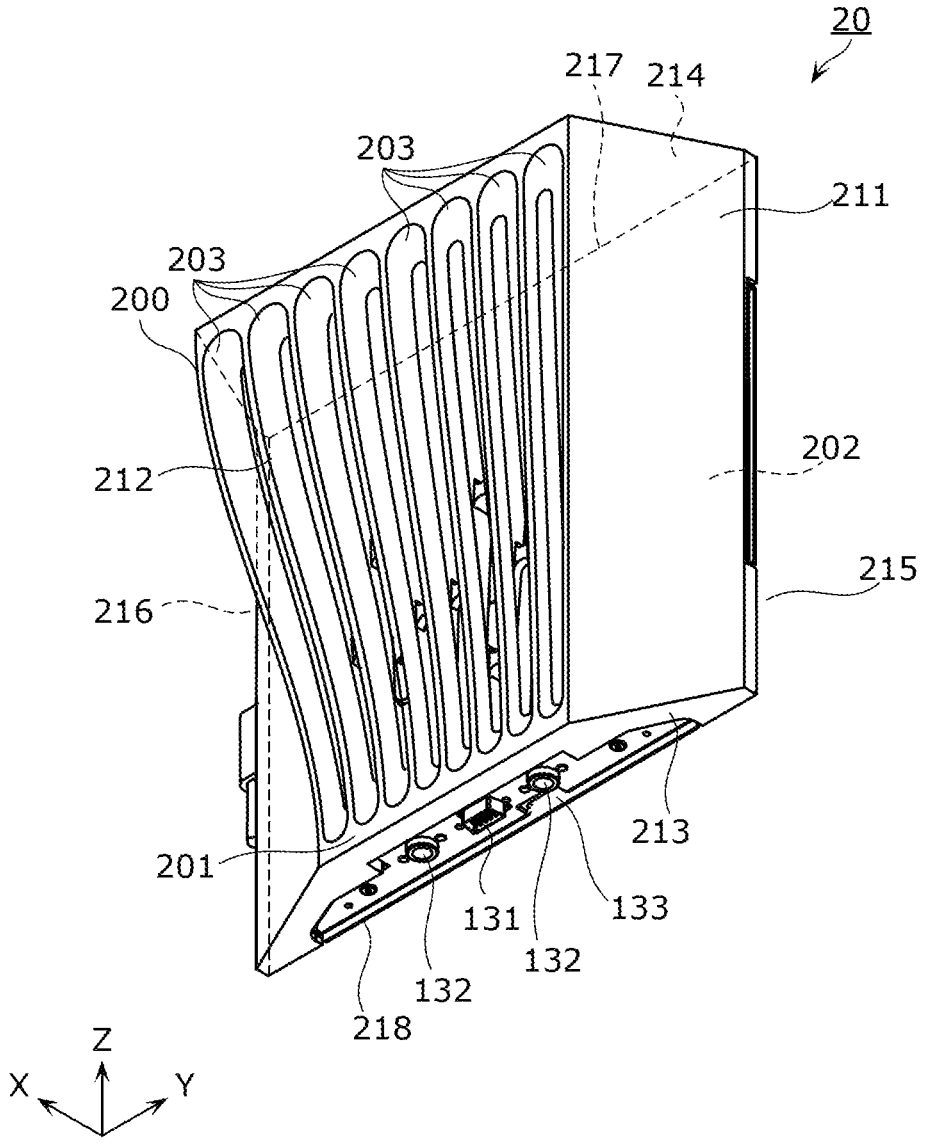
FIG. 6 is an external perspective view of the second blowing unit as seen from below.

FIG. 5 is an external perspective view of the second blowing unit as seen from above. FIG. 6 is an external perspective view of the second blowing unit as seen from below.

Second blowing unit 20 includes body 200 and a second fan (not shown). Body 200 houses the second fan, and has air outlets 203 formed in front face 201 so that wind generated by the second fan is blown out from air outlets 203. Air outlets 203 are openings penetrating through front face 201 in the X-axis direction for taking in air in front of body 200 or for blowing out air toward front of body 200. Multiple (eight in this embodiment) air outlets 203 are formed in front face 201.

Body 200 is of a shape that has two-fold symmetry with body 100 with respect to an axis of rotational symmetry parallel to the rotation axis of the second fan. That is, body 200 is approximately the same in shape as body 100 rotated 180 degrees about an axis of rotational symmetry that is parallel to the X-axis direction and that passes through the centroid in a plan view of body 100 seen from the X-axis direction.

Body 200 includes frame 210 and back panel 260. Frame 210 has front face 201, first side face 211 serving as the right-side face, and second side face 212 serving as the left-side face. Frame 210 further has part of third side face 213 serving as the bottom-side face, and part of fourth side face 214 serving as the top-side face. Back panel 260 has back face 202. Back panel 260 further has part of third side face 213 serving as the bottom face, and part of fourth side face 214 serving as the top face. The second fan is disposed in the space surrounded by front face 201, back face 202, first side face 211, second side face 212, third side face 213, and fourth side face 214 of body 200. It is to be noted that back panel 260 may have openings (not shown) for taking in air in back of body 200 or for blowing out air toward back of body 200.

First side face 211 and second side face 212 are inclined to approach each other in the Y-axis direction toward the front. That is, first side face 211 and second side face 212 each form an angle of less than 90 degrees with back face 202. First side face 211 and second side face 212 are curved so that the angle with back face 202 increases toward the top. Therefore, first angle θ11 between upper edge 221 of first side face 211 and back face 202 is greater than second angle θ12 between lower edge 222 of first side face 211 and back face 202. First angle θ11 and second angle θ12 are thus different.

Because body 100 and body 200 are 180 degrees rotationally symmetric with each other, first angle θ1 and second angle θ12 are the same and first angle θ11 and second angle θ2 are the same.

First side face 211 is of a shape that has two-fold symmetry with respect to axis 223, which is the axis of rotational symmetry, passing through the center of the width of first side face 211 in the Z-axis direction. That is, first side face 211 rotated 180 degrees about axis 223 is the same in shape as first side face 211 before being rotated 180 degrees. As with first side face 211, second side face 212 is of a shape that has two-fold symmetry with respect to axis 224, which is the axis of rotational symmetry, passing through the center of the width of second side face 212 in the Z-axis direction. That is, second side face 212 rotated 180 degrees about axis 224 is the same in shape as second side face 212 before being rotated 180 degrees.

Now, the relationship between first blowing unit 10 and second blowing unit 20 will be described with reference to FIGS. 7 and 8.

Figure 7:
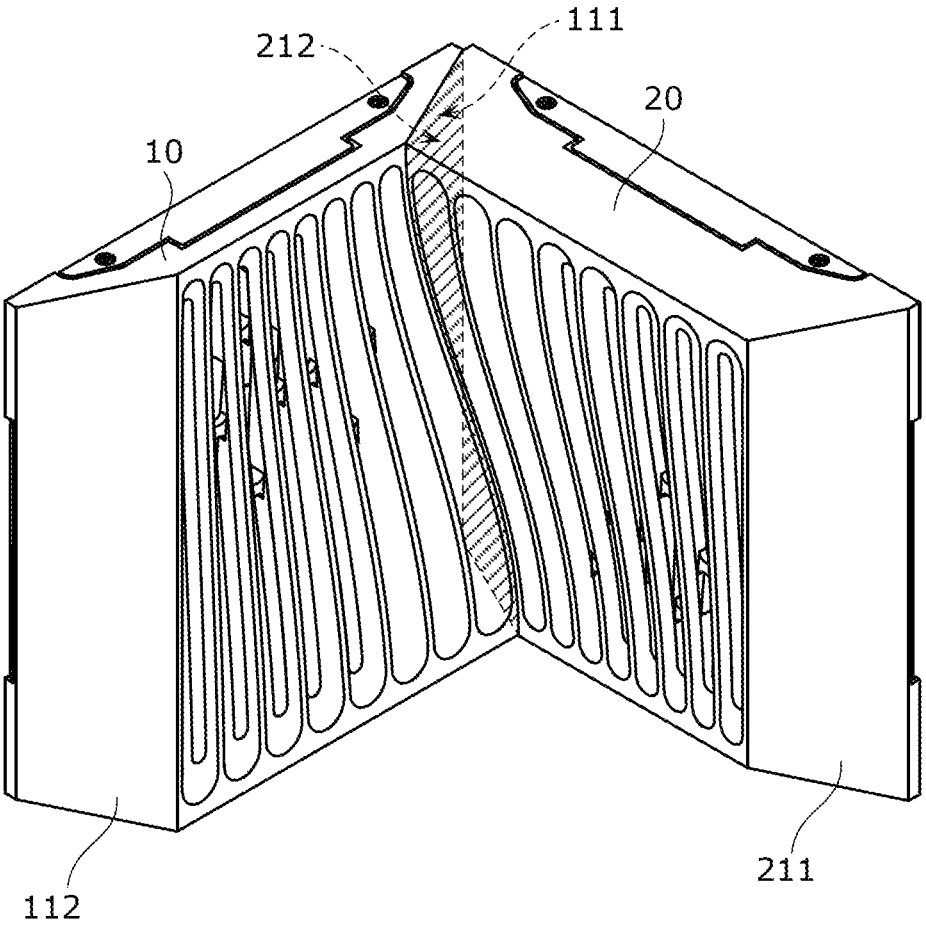
FIG. 7 is a perspective view of the first blowing unit and the second blowing unit in which the side faces on their connected sides contact each other.

FIG. 7 is a perspective view of the first blowing unit and the second blowing unit in which the side faces on their connected sides contact each other. FIG. 8 is a top view of the first to fourth blowing units connected together in which all the side faces on their connected sides contact each other.

As shown in these figures, when first blowing unit 10 and second blowing unit 20 contact each other by being rotated about first connection 91, first side face 111 of body 100 of first blowing unit 10 and second side face 212 of body 200 of second blowing unit 20 come into contact at three or more different points. Specifically, first side face 111 of body 100 and second side face 212 of body 200 come into contact in a plane that includes three or more points. Because first side face 111 and second side face 212 are both curved, the contact plane has a curved portion.

First side face 111 and second side face 112 are symmetric in the X-Z plane. First side face 211 and second side face 212 are symmetric in the X-Z plane. Body 100 and body 200 are 180 degrees rotationally symmetric. Each of first side faces 111 and 211 and second side faces 112 and 212 is of a two-fold symmetric shape. Due to the above relationships, first side face 111 and second side face 212 are of the same shape in their entire areas and therefore come into contact in their entire areas.

Further, a first direction in which first rotation axis AX1 of first fan 150 extends and a second direction in which second rotation axis AX2 of second fan 250 extends cross each other at predetermined angle α1. Predetermined angle α1 is equal to the total of first angle θ1 and first angle θ11. Because first side face 111 and second side face 212 are of the same shape in their entire areas, the total of the angle between first side face 111 and back face 102 and the angle between second side face 212 and back face 202 is equal to predetermined angle α1, in a cross section parallel to the X-Y plane at any position in the Z-axis direction. Predetermined angle α1 is 90 degrees, for example.

Thus, first connection 91 rotatably connects edge 115 of first side face 111 of body 100 and edge 216 of second side face 212 of body 200 so that the angle between body 100 and body 200, that is, the angle between back face 102 of body 100 and back face 202 of body 200, is variable. First connection 91 is a hinge, for example. First connection 91 is not limited to a hinge but may be a sheet-like flexible material, for example, adhesive tape, attached to back face 102 and back face 202.

Second blowing unit 20 and third blowing unit 30 are in the same relationship as first blowing unit 10 and second blowing unit 20 as seen from the opposite side in the Z-axis direction. Third blowing unit 30 and fourth blowing unit 40 are in the same relationship as first blowing unit 10 and second blowing unit 20.

Third blowing unit 30 includes third fan 350 and body 300. Third fan 350 is rotated about third rotation axis AX3. Body 300 houses third fan 350, and has third air outlets 303 formed in front face 301 so that wind generated by third fan 350 is blown out from third air outlets 303. Third air outlets 303 are openings penetrating through front face 301 in the X-axis direction for taking in air in front of body 300 or for blowing out air toward front of body 300. Multiple (eight in this embodiment) third air outlets 303 are formed in front face 301. Body 300 is approximately the same in shape as body 100.

Fourth blowing unit 40 includes fourth fan 450 and body 400. Fourth fan 450 is rotated about fourth rotation axis AX4. Body 400 houses fourth fan 450, and has fourth air outlets 403 formed in front face 401 so that wind generated by fourth fan 450 is blown out from fourth air outlets 403. Fourth air outlets 403 are openings penetrating through front face 401 in the X-axis direction for taking in air in front of body 400 or for blowing out air toward front of body 400. Multiple (eight in this embodiment) fourth air outlets 403 are formed in front face 401. Body 400 is approximately the same in shape as body 200.

Figure 8:
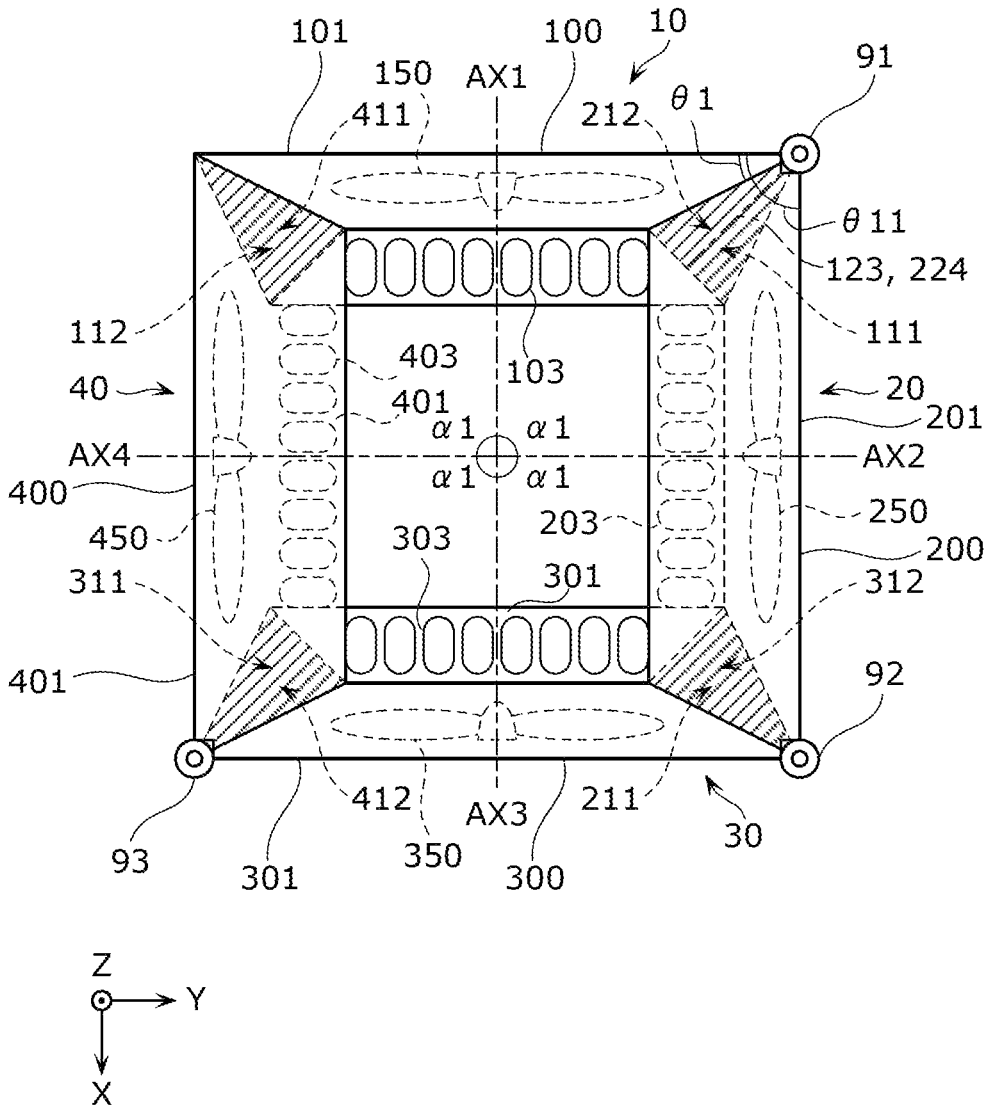
FIG. 8 is a top view of the first to fourth blowing units connected together in which all the side faces on their connected sides contact each other.

As shown in FIG. 8, when second blowing unit 20 and third blowing unit 30 contact each other by being rotated about second connection 92, first side face 211 of body 200 of second blowing unit 20 and second side face 312 of body 300 of third blowing unit 30 come into contact at three or more different points. Specifically, first side face 211 of body 200 and second side face 312 of body 300 come into contact in a plane that includes three or more points. Because first side face 211 and second side face 312 are both curved, the contact plane has a curved portion.

Further, the second direction in which second rotation axis AX2 of second fan 250 extends and a third direction in which third rotation axis AX3 of third fan 350 extends cross each other at predetermined angle $\alpha$1. Because first side face 211 and second side face 312 are of the same shape in their entire areas, the total of the angle between first side face 211 and back face 202 and the angle between second side face 312 and back face 302 is equal to predetermined angle $\alpha$1, in a cross section parallel to the X-Y plane at any position in the Z-axis direction.

Thus, second connection 92 rotatably connects edge 215 of first side face 211 of body 200 and an edge of second side face 312 of body 300 so that the angle between body 200 and body 300, that is, the angle between back face 202 of body 200 and back face 302 of body 300, is variable. Second connection 92 is a hinge, for example. Second connection 92 is not limited to a hinge but may be a sheet-like flexible material, for example, adhesive tape, attached to back face 202 and back face 302.

When third blowing unit 30 and fourth blowing unit 40 contact each other by being rotated about third connection 93, first side face 311 of body 300 of third blowing unit 30 and second side face 412 of body 400 of fourth blowing unit 40 come into contact at three or more different points. Specifically, first side face 311 of body 300 and second side face 412 of body 400 come into contact in a plane that includes three or more points. Because first side face 311 and second side face 412 are both curved, the contact plane has a curved portion.

Further, the third direction in which third rotation axis AX3 of third fan 350 extends and a fourth direction in which fourth rotation axis AX4 of fourth fan 450 extends cross each other at predetermined angle $\alpha$1. Because first side face 311 and second side face 412 are of the same shape in their entire areas, the total of the angle between first side face 311 and back face 302 and the angle between second side face 412 and back face 402 is equal to predetermined angle $\alpha$1, in a cross section parallel to the X-Y plane at any position in the Z-axis direction.

Thus, third connection 93 rotatably connects an edge of first side face 311 of body 300 and an edge of second side face 412 of body 400 so that the angle between body 300 and body 400, that is, the angle between back face 302 of body 300 and back face 402 of body 400, is variable. Third connection 93 is a hinge, for example. Third connection 93 is not limited to a hinge but may be a sheet-like flexible material, for example, adhesive tape, attached to back face 302 and back face 402.

When first side face 111 of body 100 and second side face 212 of body 200 contact each other, and first side face 211 of body 200 and second side face 312 of body 300 contact each other, and first side face 311 of body 300 and second side face 412 of body 400 contact each other, first side face 411 of body 400 and second side face 112 of body 100 contact each other. First side face 411 and second side face 112 contact each other at three or more points. Specifically, first side face 411 of body 400 and second side face 112 of body 100 come into contact in a plane that includes three or more points. Because first side face 411 and second side face 112 are both curved, the contact plane has a curved portion.

Figure 9:
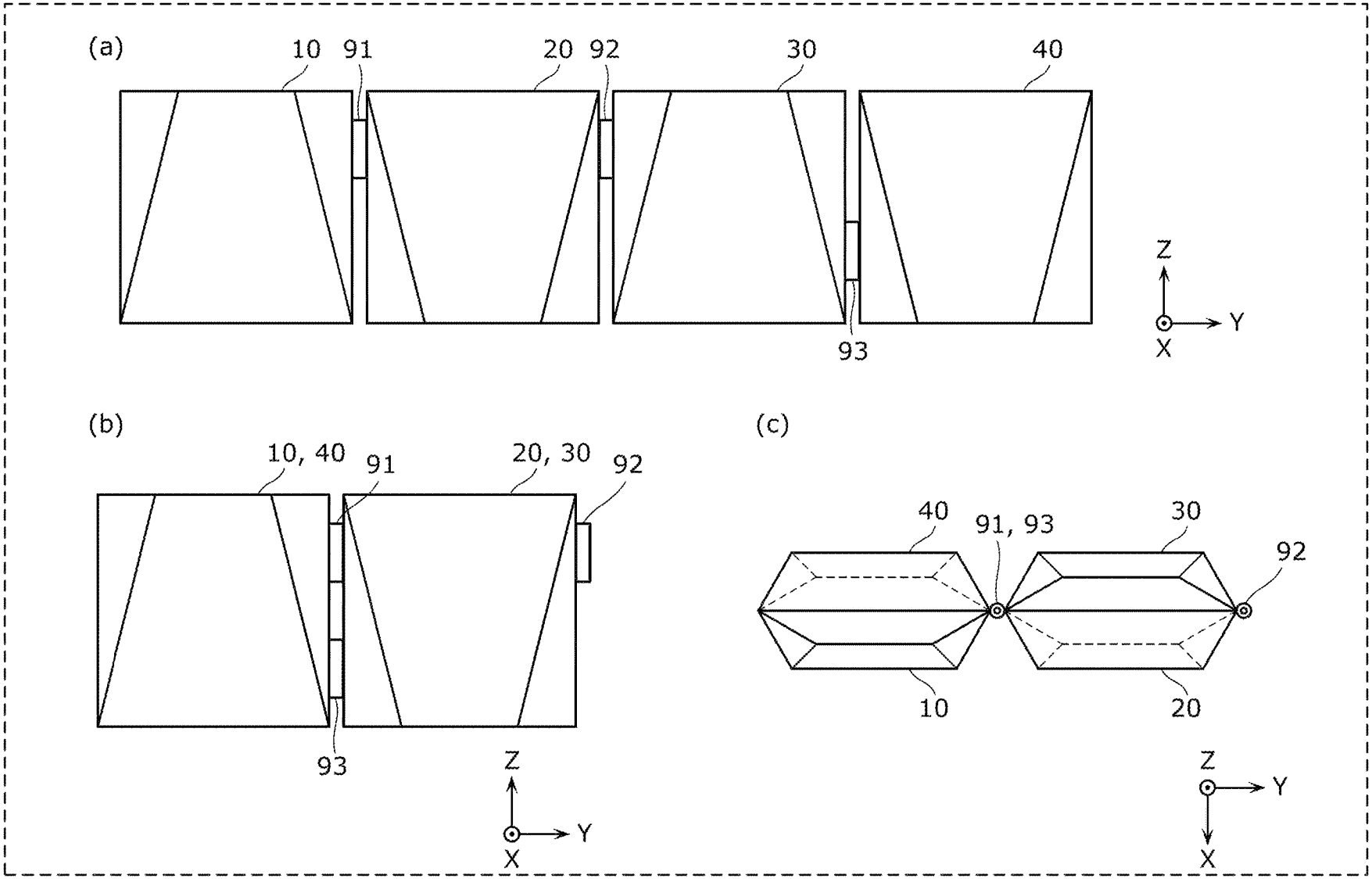
FIG. 9 is a diagram of two bodies paired back-to-back by rotating 180 degrees about a second connection.

FIG. 9 is a diagram of two bodies paired back-to-back by rotating 180 degrees about the second connection.

As shown in (a) in FIG. 9, first connection 91 and third connection 93 are at different positions in the Z-axis direction. As shown in (b) and (c) in FIG. 9, body 200 and body 300 are rotated about second connection 92 at an angle such that back face 202 of body 200 and back face 302 of body 300 oppose each other, and back face 102 of body 100 and back face 402 of body 400 oppose each other. Because first connection 91 and third connection 93 are located at non-overlapping positions, the back faces of bodies 100 and 200 can contact the back faces of bodies 300 and 400 without interference between the connections.

Figure 10:
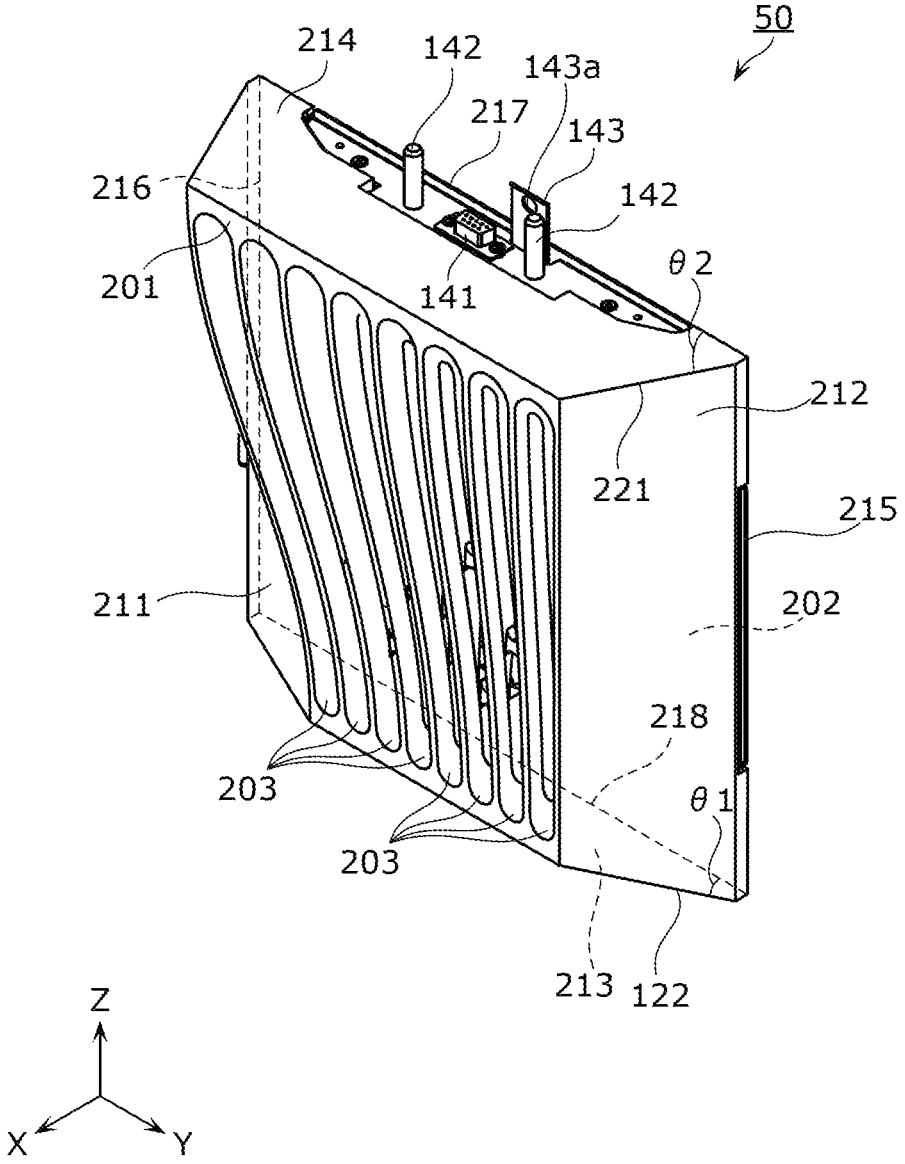
FIG. 10 is an external perspective view of a fifth blowing unit as seen from above.
Figure 11:
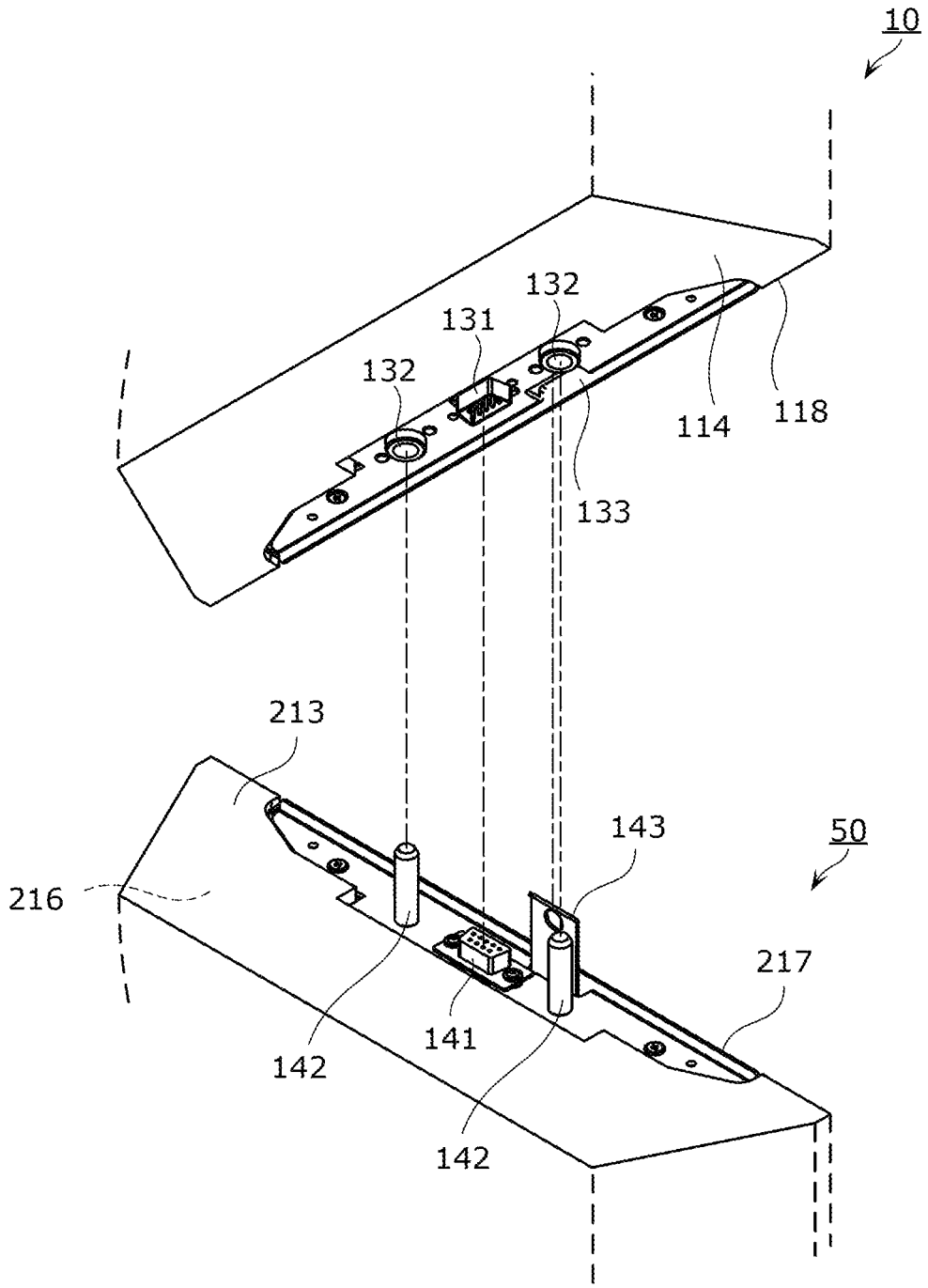
FIG. 11 is a diagram for describing connection between the first blowing unit and the fifth blowing unit.

Now, the configuration of fifth blowing unit 50 and connection between first blowing unit 10 and fifth blowing unit 50 will be described with reference to FIGS. 10 and 11. FIG. 10 is an external perspective view of the fifth blowing unit as seen from above. FIG. 11 is a diagram for describing connection between the first blowing unit and the fifth blowing unit.

In addition to the components of second blowing unit 20, fifth blowing unit 50 further includes components disposed on fourth side face 214, including second connector 141 for supplying power, two rod-shaped protrusions 142, and plate-shaped protrusion 143 having through-hole 143*a* formed therein. Second connector 141 is a female connector having a concealed terminal for supplying power.

Second connector 141, two rod-shaped protrusions 142, and plate-shaped protrusion 143 of fifth blowing unit 50 oppose first connector 131, two insertion holes 132, and opening 133 of first blowing unit 10, respectively, in the Z-axis direction. Two rod-shaped protrusions 142 are designed to fit into respective two insertion holes 132. Inserting two rod-shaped protrusions 142 of fifth blowing unit 50 into two insertion holes 132 of first blowing unit 10 allows fifth blowing unit 50 to be guided by two protrusions 142 and two insertion holes 132 and move in the Z-axis direction without being skewed with respect to first blowing unit 10. Second connector 141 is thus connected to first connector 131. Plate-shaped protrusion 143 is inserted into opening 133.

Figure 12:
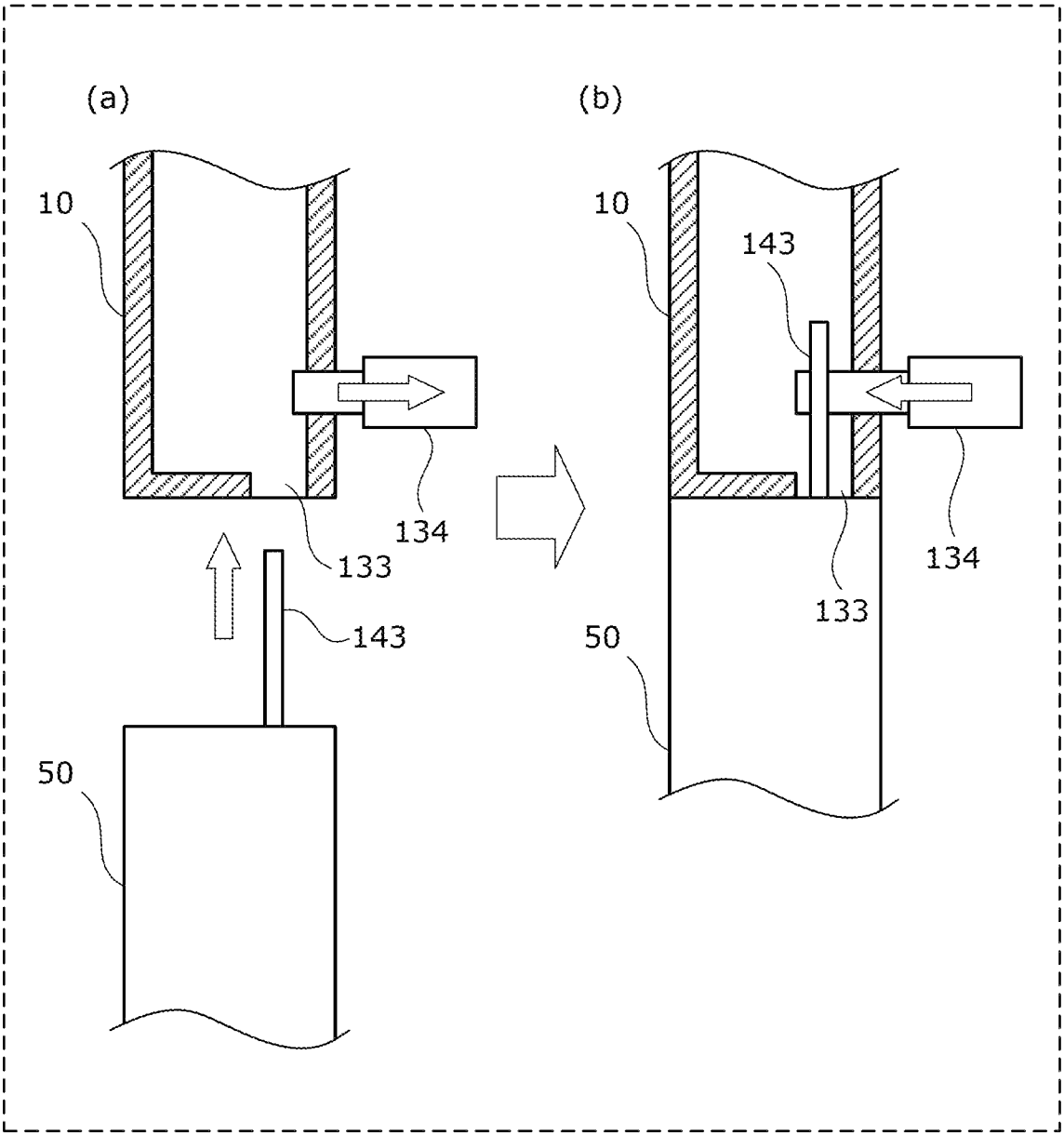
FIG. 12 is a sectional view of a connection part between the first blowing unit and the fifth blowing unit.

The inside of opening 133 of first blowing unit 10 will be described with reference to FIG. 12. FIG. 12 is a sectional view of a connection part between the first blowing unit and the fifth blowing unit.

(a) in FIG. 12 is a sectional view of a connection part before the first blowing unit and the fifth blowing unit are connected. (b) in FIG. 12 is a sectional view of the connection part after the first blowing unit and the fifth blowing unit are connected.

Plunger 134 is disposed in opening 133 of first blowing unit 10. Plunger 134 extends off the back face of body 100 of first blowing unit 10 to be urged forward from the back-face side. To connect fifth blowing unit 50 to first blowing unit 10, a user inserts two protrusions 142 into two insertion holes 132 while pulling plunger 134 backward, and moves fifth blowing unit 50 toward first blowing unit 10 in the Z-axis direction. Plate-shaped protrusion 143 is accordingly inserted into opening 133. Once plate-shaped protrusion 143 is inserted into opening 133, the user releases plunger 134 from the pulled state (i.e., releases the user's hold on plunger 134). Through-hole 143a in plate-shaped protrusion 143 inserted into opening 133 aligns with the tip of plunger 134 in a front view. Because plunger 134 is urged forward, releasing plunger 134 causes the tip of plunger 134 to move forward and penetrate through through-hole 143*a*. First blowing unit 10 and fifth blowing unit 50 are thus connected.

In the above manner, third side face 113, which is approximately orthogonal to edge 115 on the back-face side of first side face 111 of body 100, is connected with fourth side face 214 of body 200 of fifth blowing unit 50.

Connection between first blowing unit 10 and fifth blowing unit 50 as above also applies to connection between second blowing unit 20 and sixth blowing unit 60, connection between third blowing unit 30 and seventh blowing unit 70, and connection between fourth blowing unit 40 and eighth blowing unit 80, which will therefore not be described in detail.

Figure 13:
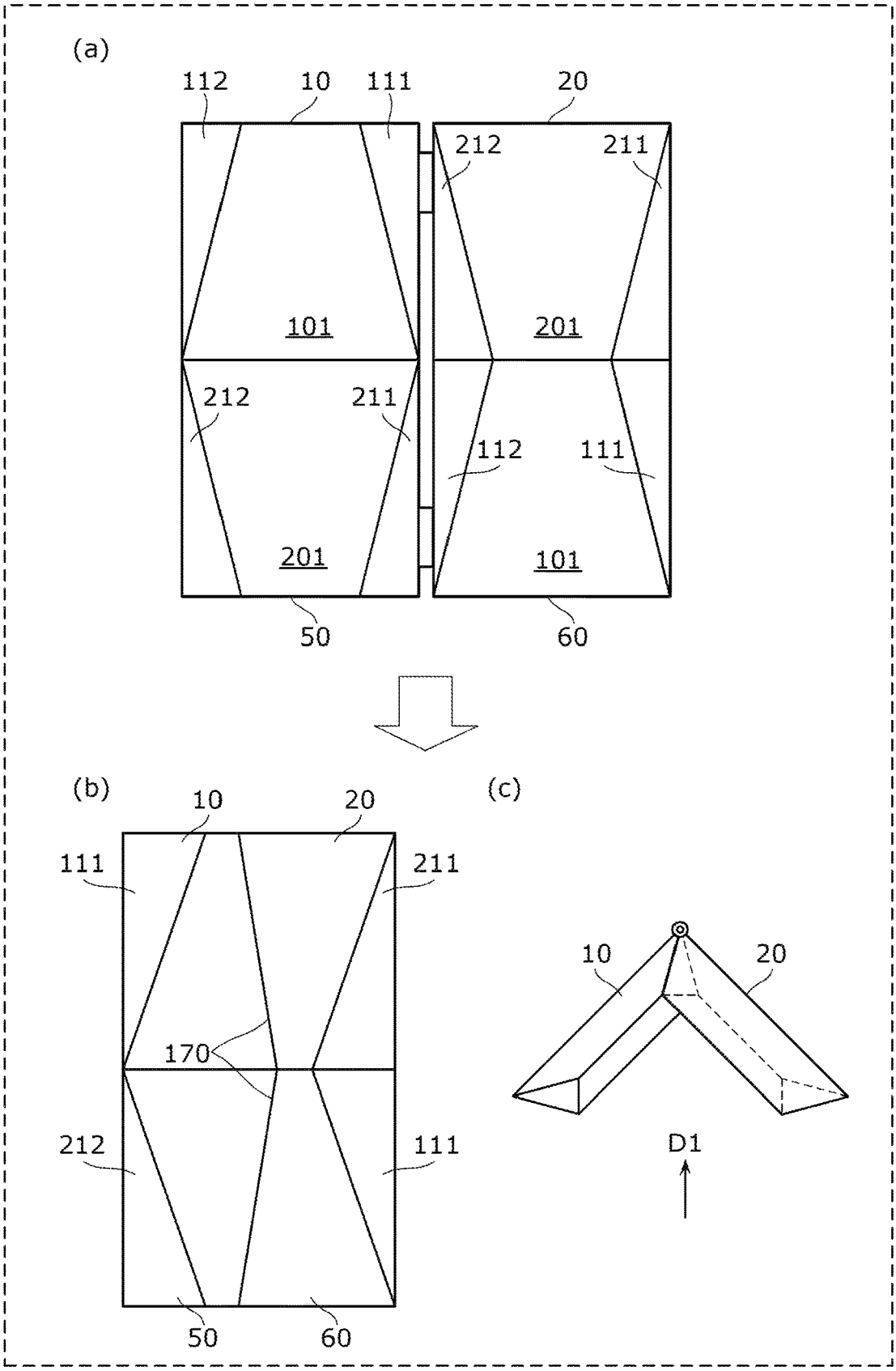
FIG. 13 is a diagram for describing the first blowing unit, the second blowing unit, the fifth blowing unit, and a sixth blowing unit connected together.

FIG. 13 is a diagram for describing the first blowing unit, the second blowing unit, the fifth blowing unit, and the sixth blowing unit connected together. (a) in FIG. 13 is a diagram illustrating a configuration of first blowing unit 10, second blowing unit 20, fifth blowing unit 50, and sixth blowing unit 60 connected together. (b) and (c) of FIG. 13 are diagrams illustrating first blowing unit 10, second blowing unit 20, fifth blowing unit 50, and sixth blowing unit 60 in which the side faces on their connected sides contact each other. (b) in FIG. 13 is a diagram as seen from direction D1 shown in (c) in FIG. 13. (c) in FIG. 13 a top view of the blowing units connected together.

As shown in FIG. 13, first blowing unit 10 and fifth blowing unit 50 are connected to provide the combination of front face 101 of first blowing unit 10 and front face 201 of fifth blowing unit 50 having a shape in which the width in the Y-axis direction is the widest at the center in the Z-axis direction. Conversely, second blowing unit 20 and sixth blowing unit 60 are connected to provide the combination of front face 201 of second blowing unit 20 and front face 101 of sixth blowing unit 60 having a shape in which the width in the Y-axis direction is the narrowest at the center in the Z-axis direction. The shape of the combination of front face 101 of first blowing unit 10 and front face 201 of fifth blowing unit 50, having the widest width in the Y-axis direction at the center in the Z-axis direction, fits the shape of the combination of front face 201 of second blowing unit 20 and front face 101 of sixth blowing unit 60, having the narrowest width in the Y-axis direction at the center in the Z-axis direction. That is, the convex portion on a side of the combination of front face 101 of first blowing unit 10 and front face 201 of fifth blowing unit 50 fits the concave portion on a side of the combination of front face 201 of second blowing unit 20 and front face 101 of sixth blowing unit 60. This prevents misalignment between the connected structure of first blowing unit 10 and fifth blowing unit 50 and the connected structure of second blowing unit 20 and sixth blowing unit 60 in the Z-axis direction while their side faces contact each other. Consequently, first blowing unit 10, second blowing unit 20, fifth blowing unit 50, and sixth blowing unit 60 can function more effectively as a single rigid body.

Figure 14:
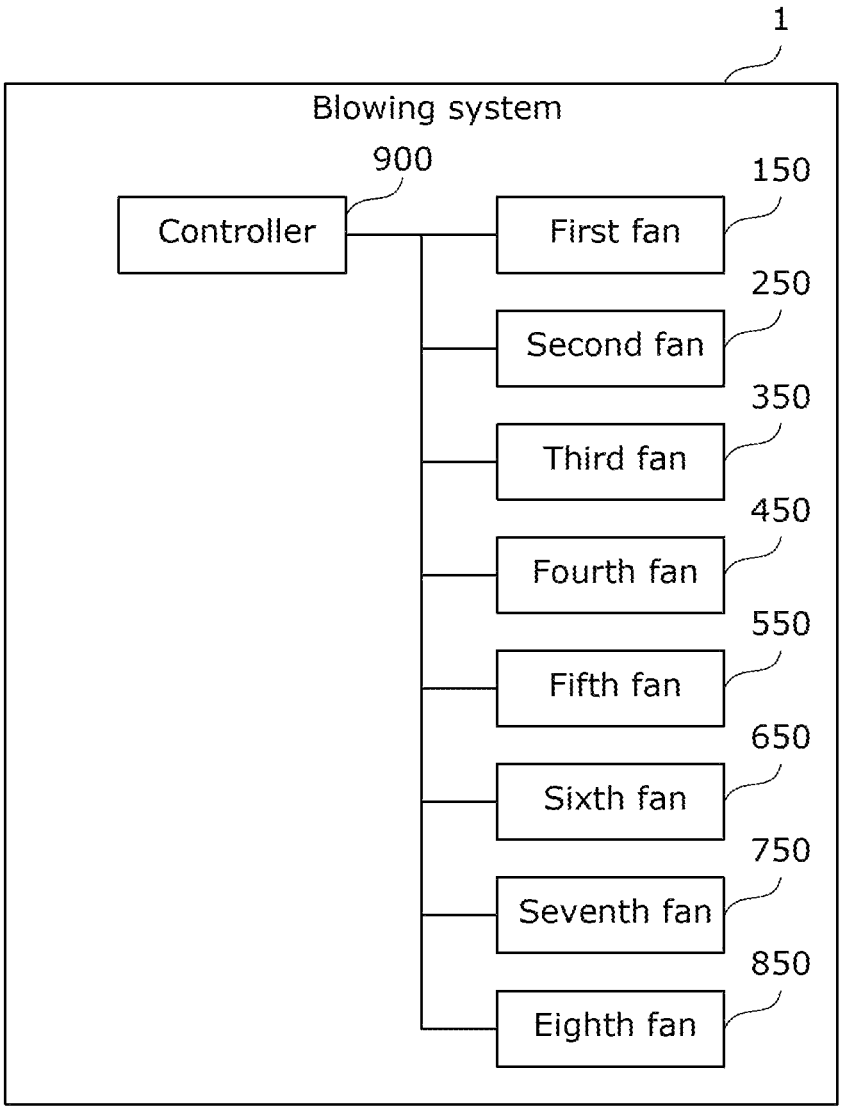
FIG. 14 is a block diagram illustrating an exemplary functional configuration of the blowing system.

FIG. 14 is a block diagram illustrating an exemplary functional configuration of the blowing system.

Functionally, blowing system 1 includes controller 900, first fan 150, second fan 250, third fan 350, fourth fan 450, fifth fan 550, sixth fan 650, seventh fan 750, and eighth fan 850. Hereafter, first fan 150, second fan 250, third fan 350, fourth fan 450, fifth fan 550, sixth fan 650, seventh fan 750, and eighth fan 850 will be denoted as first to eighth fans 150 to 850.

Controller 900 is a control circuit that independently controls each of first to eighth fans 150 to 850. Controller 900 may include memory that stores predetermined programs, and a processor that executes the predetermined programs. Controller 900 may be a dedicated processing circuit for controlling first to eighth fans 150 to 850. That is, the functions of controller 900 may be implemented in software or in hardware.

For example, controller 900 controls the rotation direction of each of first to eighth fans 150 to 850. Controller 900 controls each of first to eighth fans 150 to 850 to be rotated in the forward direction to blow out wind toward front, or to be rotated in the backward direction to blow out wind toward back. Controller 900 controls the rotation speed of each of first to eighth fans 150 to 850 to adjust the volume of wind blown out.

Controller 900 also controls the operation timing for each of first to eighth fans 150 to 850. For example, controller 900 may sequentially drive each fan according to shifted timing. That is, controller 900 may drive first fan 150 and fifth fan 550 according to first timing, drive second fan 250 and sixth fan 650 according to second timing following the first timing, drive third fan 350 and seventh fan 750 according to third timing following the second timing, and drive fourth fan 450 and eighth fan 850 according to fourth timing following the third timing. In this manner, wind can be blown out toward varying directions according to the order of driving the fans and the orientations of the fans.

With blowing system 1 according to this embodiment, when blowing system 1 is arranged to cause the first direction of first rotation axis AX1 of first fan 150 to cross the second direction of second rotation axis AX2 of second fan 250 at predetermined angle $\alpha$1, first side face 111 of body 100 and second side face 212 of body 200 come into contact at three or more different points. For example, first side face 111 and second side face 212 come into contact in a plane that includes three or more points. This enables body 100 and body 200 to function as a single rigid body. Thus, vibrations generated in blowing system 1 can be reduced.

In blowing system 1, the plane in which first side face 111 and second side face 212 come into contact includes a curved portion. Consequently, first side face 111 and second side face 212 come into contact in a wider area when contacting each other. This enables body 100 and body 200 to function more effectively as a single rigid body, thereby further reducing vibrations generated in blowing system 1.

In blowing system 1, first side face 111 is of a shape that has two-fold symmetry with respect to axis 123, and second side face 212 is of a shape that has two-fold symmetry with respect to axis 224. Consequently, first side face 111 of body 100 and second side face 212 of body 200 come into contact in their entire areas when contacting each other. This enables body 100 and body 200 to function more effectively as a single rigid body. Thus, vibrations generated in blowing system 1 can be further reduced.

In blowing system 1, edge 121 of first side face 111 of body 100 at one end of edge 115, on the back face 102-side, forms first angle $\theta$1 with back face 102 of body 100. Edge 122 of first side face 111 of body 100 at the other end of edge 115, on the back face 102-side, forms second angle $\theta$2, different from first angle $\theta$1, with back face 102 of body 100.

In this manner, the edge, on the front face 101-side, of first side face 111 of body 100 can be elongated to increase the area of first side face 111. This also applies to second side face 212 of body 200, because second side face 212 is the same in shape as first side face 111 of body 100. Consequently, first side face 111 of body 100 and second side face 212 of body 200 come into contact in a wider area when contacting each other. This enables body 100 and body 200 to function more effectively as a single rigid body, thereby reducing vibrations generated in blowing system 1.

According to blowing system 1, when first side face 111 of body 100 and second side face 212 of body 200 contact each other, and first side face 211 of body 200 and second side face 312 of body 300 contact each other, and first side face 311 of body 300 and second side face 412 of body 400 contact each other, first side face 411 of body 400 and second side face 112 of body 100 contact each other. That is, bodies 100, 200, 300, and 400 are arranged circularly and contact each adjacent body in a plane. This enables bodies 100, 200, 300, and 400 to function more effectively as a single rigid body. Thus, vibrations generated in blowing system 1 can be further reduced.

According to blowing system 1, the edges on the back-face sides of the first side face and the second side face of each of bodies 100, 200, 300, and 400 extend in approximately the same direction, that is, the Z-axis direction. The position of first connection 91 in the Z-axis direction is different from the position of third connection 93 in the Z-axis direction. As such, when the back faces of body 100 and body 200 are disposed to oppose the back faces of body 300 and body 400, first connection 91 connecting body 100 and body 200 does not interfere with third connection 93 connecting body 300 and body 400. Consequently, blowing system 1 can be arranged in a shape such that the back face of body 100 contacts the back face of body 400, and the back face of body 200 contacts the back face of body 300. This enables bodies 100, 200, 300, and 400 to function more effectively as a single rigid body, thereby further reducing vibrations generated in blowing system 1.

According to blowing system 1, when the system is arranged to cause a fifth direction of a fifth rotation axis of fifth fan 550 to cross a sixth direction of a sixth rotation axis of sixth fan 650 at predetermined angle $\alpha 1$, the first side face of the fifth body and the second side face of the sixth body come into contact at three or more different points. This enables the fifth body and the sixth body to function as a single rigid body. Thus, vibrations generated in the blowing system can be reduced.

According to blowing system 1, first connector 131 for receiving power is a male connector, and second connector 141 for supplying power is a female connector. This can prevent a person from accidentally touching the terminal of second connector 141 that is ready to supply power.

(Variation 1)

The above embodiment has illustrated predetermined angle $\alpha 1$ of 90 degrees, which is 360 degrees divided by 4, i.e., the number of bodies arranged circularly with their side faces contacting the adjacent side faces. However, predetermined angle $\alpha 1$ is not limited to 90 degrees. For N bodies arranged circularly with their side faces contacting the adjacent side faces, predetermined angle $\alpha 1$ may be 360/N, which is 360 degrees divided by the number of bodies N. For example, for three bodies arranged circularly, predetermined angle $\alpha 1$ may be 120 degrees. For five bodies arranged circularly, predetermined angle $\alpha 1$ may be 72 degrees. For six bodies arranged circularly, predetermined angle $\alpha 1$ may be 60 degrees.

(Variation 2)

The above embodiment has illustrated blowing system 1 that includes eight blowing units. However, the number of blowing units is not limited to eight. For example, blowing system 1 may include two blowing units shown in FIG. 7.

(Variation 3)

The above embodiment has illustrated first side face 111 of body 100 and second side face 212 of body 200 that come into contact in a plane. However, this is not limiting. The faces need not come into contact in a plane but may come into contact at, at least, three different points. If the faces come into contact at, at least, three different points, the faces may come into contact at three points, including two different points in the front-back direction and two different points in the top-bottom direction of first side face 111 and second side face 212.

(Variation 4)

The above embodiment has illustrated curved first side face 111 and curved second side face 112 of body 100. However, these faces may be planar. For example, if the first side face and the second side face are planar, the first side face and the second side face may be trapezoidal or triangular. In this case, each of the first side face and the second side face need not be of a two-fold symmetric shape.

(Variation 5)

The above embodiment has illustrated curved first side face 111 and curved second side face 112 of body 100 each having four corners and four sides. However, these faces may be curved faces each having three corners and three sides, or curved faces each having five or more corners and five or more sides.

(Variation 6)

The blowing system may include not only the combination of blowing units illustrated in the above embodiment but any combination of blowing units.

Figure 15:
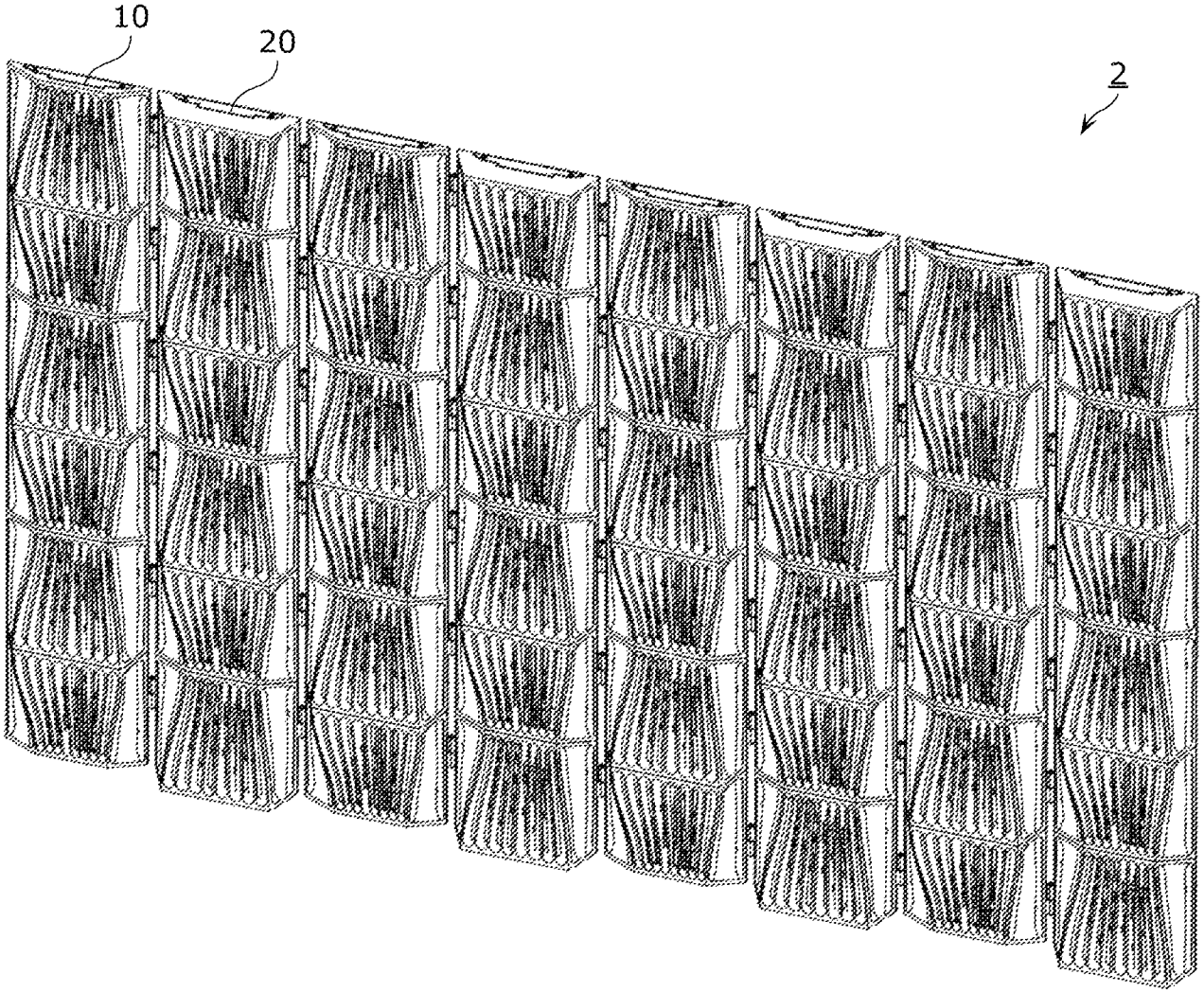
FIG. 15 is an external perspective view of a blowing system according to Variation 5.

For example, as shown in FIG. 15, blowing system 2 may combine a total of 48 blowing units 10 and 20 arranged in six rows by eight columns.

Figure 16:
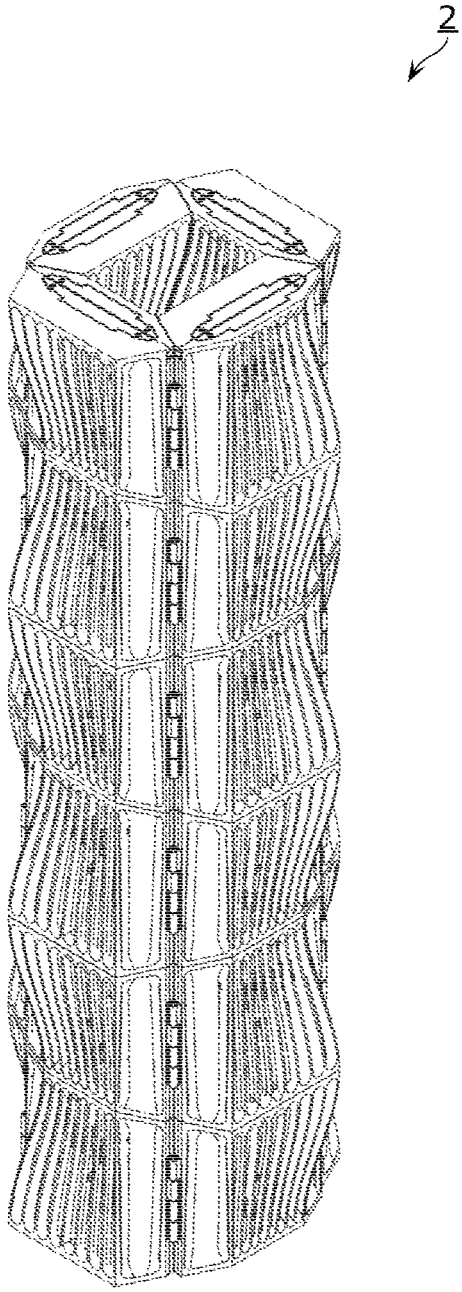
FIG. 16 is an external perspective view of the blowing system according to Variation 5.

For example, as shown in FIG. 16, blowing system 2 may be folded at the connections so that each set of 8 blowing units form a double circle.

(Variation 7)

In the above embodiment, the bodies of adjacent ones of blowing units 10 to 80 are the same in shape but are oriented in the vertically opposite directions. However, this is not limiting. As an example, the bodies of first to fourth blowing units 10 to 40 in the upper tier may be different in shape from the bodies of fifth to eighth blowing units 50 to 80 in the lower tier. As another example, the bodies of first to fourth blowing units 10 to 40 in the upper tier may include first side face 111 and second side face 112 having a curved portion with three corners and three sides as described in Variation 5; whereas the bodies of fifth to eighth blowing units 50 to 80 in the lower tier may include first side face 111 and second side face 112 having a curved portion with four corners and four sides as described in the above embodiment.

(Variation 8)

In the above embodiment, when first blowing unit 10 and second blowing unit 20 contact each other by being rotated about first connection 91, first side face 111 of body 100 and second side face 212 of body 200 come into contact at three or more different points. However, this is not limiting. For example, when first blowing unit 10 and second blowing unit 20 contact each other by being rotated about first connection 91, first side face 111 of body 100 and second side face 212 of body 200 may come into contact at one point. That is, first side face 111 of body 100 and second side face 212 of body 200 may come into contact at one point and need not come into contact anywhere other than the one point.

In the above description, first blowing unit 10 and second blowing unit 20 are rotated about first connection 91, so that the first direction in which first rotation axis AX1 extends and the second direction in which second rotation axis AX2 extends cross each other at a predetermined angle. First side face 111 of body 100 and second side face 212 of body 200 then come into contact at three or more different points. However, this is not limiting, and first side face 111 and second side face 212 need not come into contact. That is, when body 100 and body 200 are arranged to cause the first direction and the second direction to cross each other at the predetermined angle, first side face 111 and second side face 212 may be spaced apart.

As above, body 100 and body 200 can be rotated about first connection 91 to cause the first direction and the second direction to cross each other at the predetermined angle, even though first side face 111 and second side face 212 are spaced apart. This enables a compact arrangement of body 100 and body 200.

Although blowing systems according to one or more aspects of the present disclosure have been described above, the present disclosure is not limited to the foregoing exemplary embodiments. The one or more aspects may thus include forms obtained by making various modifications to the above embodiments that can be conceived by those skilled in the art, as well as forms obtained by combining structural components in different embodiments, without materially departing from the spirit of the present disclosure.

INDUSTRIAL APPLICABILITY

The present disclosure is useful as a blowing system and so on capable of reducing vibrations generated.

The invention claimed is:

1. A blowing system, comprising:

a first blowing unit including a first fan configured to rotate about a first rotation axis and a first body that is configured to house the first fan and includes, in a front face of the first body, a first air outlet from which wind generated by the first fan is blown out;

a second blowing unit including a second fan configured to rotate about a second rotation axis and a second body that is configured to house the second fan and includes, in a front face of the second body, a second air outlet from which wind generated by the second fan is blown out, the second body being of a shape that is in two-fold symmetry with the first body with respect to a first axis of rotational symmetry which is parallel to the second rotation axis; and a first connection configured to rotatably connect an edge on a back face-side of a first side face of the first body and an edge on a back face-side of a second side face of the second body so that an angle formed by the first body and the second body is variable, wherein when the first blowing unit and the second blowing unit contact each other by being rotated about the first connection, the first side face of the first body and the second side face of the second body come into contact at three or more points which are mutually different, and a first direction in which the first rotation axis extends and a second direction in which the second rotation axis extends cross each other at a predetermined angle.

2. The blowing system according to claim 1, wherein the first side face of the first body and the second side face of the second body come into contact in a plane that includes the three or more points.

3. The blowing system according to claim 2, wherein the plane in which the first side face of the first body and the second side face of the second body come into contact includes a curved portion.

4. The blowing system according to claim 1, wherein the first side face of the first body is of a shape that has two-fold symmetry with respect to a second axis of rotational symmetry, and the second side face of the second body is of a shape that has two-fold symmetry with respect to a third axis of rotational symmetry.

5. The blowing system according to claim 1, wherein the edge of the first side face of the first body at one end of the edge on a back face-side of the first side face of the first body and a back face of the first body form a first angle, and the edge of the first side face of the first body at an other end of the edge on a back face-side of the first side face of the first body and a back face of the first body form a second angle different from the first angle.

6. The blowing system according to claim 1, further comprising:

a third blowing unit including a third fan configured to rotate about a third rotation axis and a third body that is configured to house the third fan and includes, in a front face of the third body, a third air outlet from which wind generated by the third fan is blown out, the third body being of a shape that is approximately identical to a shape of the first body;

a fourth blowing unit including a fourth fan configured to rotate about a fourth rotation axis and a fourth body that is configured to house the fourth fan and includes, in a front face of the fourth body, a fourth air outlet from which wind generated by the fourth fan is blown out, the fourth body being of a shape that is approximately identical to a shape of the second body;

a second connection configured to rotatably connect an edge on a back face-side of a first side face opposite the second side face of the second body and an edge on a back face-side of a second side face of the third body so that an angle formed by the second body and the third body is variable; and a third connection configured to rotatably connect an edge on a back face-side of a first side face opposite the second side face of the third body and an edge on a back face-side of a second side face of the fourth body so that an angle formed by the third body and the fourth body is variable, wherein when the second blowing unit and the third blowing unit contact each other by being rotated about the second connection, the first side face of the second body and the second side face of the third body come into contact at three or more points which are mutually different, and the second direction and a third direction in which the third rotation axis extends cross each other at the predetermined angle, when the third blowing unit and the fourth blowing unit contact each other by being rotated about the third connection, the first side face of the third body and the second side face of the fourth body come into contact at three or more points which are mutually different, and the third direction and a fourth direction in which the fourth rotation axis extends cross each other at the predetermined angle, and when the first side face of the first body and the second side face of the second body contact each other, and the first side face of the second body and the second side face of the third body contact each other, and the first side face of the third body and the second side face of the fourth body contact each other, the first side face of the fourth body and the second side face of the first body contact each other.

7. The blowing system according to claim 6, wherein edges on back face-sides of the first side face and the second side face of each of the first body, the second body, the third body, and the fourth body extend in an approximately same direction, and a position of the first connection in the approximately same direction is different from a position of the third connection in the approximately same direction.

8. The blowing system according to claim 1, further comprising:

a fifth blowing unit including a fifth fan configured to rotate about a fifth rotation axis and a fifth body that is configured to house the fifth fan and includes, in a front face of the fifth body, a fifth air outlet from which wind generated by the fifth fan is blown out, the fifth body being of a shape that is approximately identical to a shape of the second body;

a sixth blowing unit including a sixth fan configured to rotate about a sixth rotation axis and a sixth body that is configured to house the sixth fan and includes, in a front face of the sixth body, a sixth air outlet from which wind generated by the sixth fan is blown out, the sixth body being of a shape that is approximately identical to a shape of the first body; and a fifth connection configured to rotatably connect an edge on a back face-side of a first side face the fifth body and an edge on a back face-side of a second side face of the sixth body so that an angle formed by the fifth body and the sixth body is variable, wherein a third side face of the first body is connected to a fourth side face of the fifth body, the third side face of the first body being approximately orthogonal to the edge on the back face-side of the first side face of the first body, the fourth side face of the fifth body being approximately orthogonal to the edge on the back face-side of the first side face the fifth body, a third side face of the second body is connected to a fourth side face of the sixth body, the third side face of the second body being approximately orthogonal to the edge on the back face-side of the second side face of the second body, the fourth side face of the sixth body being approximately orthogonal to the edge on the back face-side of the second side face the sixth body, and when the fifth blowing unit and the sixth blowing unit contact each other by being rotated about the fifth connection, the first side face of the fifth body and the second side face of the sixth body come into contact at three or more points which are mutually different, and a fifth direction in which the fifth rotation axis extends and a sixth direction in which the sixth rotation axis extends cross each other at a predetermined angle.

9. The blowing system according to claim 8, wherein the first blowing unit further includes a first connector disposed in the third side face of the first body and configured to receive power, the second blowing unit further includes a first connector disposed on the third side face of the second body and configured to receive power, the fifth blowing unit further includes a second connector disposed on a fourth side face opposite a third side face of the fifth body and configured to supply power, the sixth blowing unit further includes a second connector disposed on a fourth side face opposite a third side face of the fifth body and configured to supply power, each of the first connector of the first blowing unit and the first connector of the second blowing unit is a male connector including a protruding terminal for receiving power, each of the second connector of the fifth blowing unit and the second connector of the sixth blowing unit is a female connector including a concealed terminal for supplying power, the first connector of the first blowing unit is connected to the second connector of the fifth blowing unit by connecting the first body and the fifth body, and the first connector of the second blowing unit is connected to the second connector of the sixth blowing unit by connecting the first body and the fifth body.

* * * * *